United States Patent [19]

Dubnowski et al.

[11] 4,015,088

[45] Mar. 29, 1977

[54] REAL-TIME SPEECH ANALYZER

[76] Inventors: John Joseph Dubnowski, Hampton; Lawrence Richard Rabiner, Berkeley Heights, both of N.J.; Ronald William Schafer, Atlanta, Ga.

[73] Assignee: Bell Telephone Laboratories, Incorporated, Murray Hill, N.J.

[22] Filed: Oct. 31, 1975

[21] Appl. No.: 627,865

[52] U.S. Cl. ..... 179/1 SC

[51] Int. Cl.[2] ..... G10L 1/04

[58] Field of Search ..... 179/1 SA, 1 SC; 235/181

[56] References Cited

UNITED STATES PATENTS

| | | | |
|---|---|---|---|
| 2,908,761 | 10/1959 | Raisbeck | 179/1 SA |
| 3,381,091 | 4/1968 | Sondhi | 179/1 SA |
| 3,405,237 | 10/1968 | David | 179/1 SA |
| 3,626,168 | 12/1971 | Norsworthy | 235/181 |

*Primary Examiner*—Kathleen H. Claffy
*Assistant Examiner*—E. S. Kemeny
*Attorney, Agent, or Firm*—J. S. Cubert

[57] ABSTRACT

Apparatus for the real-time analysis of speech signals in which a digital signal representative of the speech signal is adaptive threshold center-clipped and infinite peak-clipped to form a signal comprising three logic states (+1,0,−1). The autocorrelation function of this signal is determined by a circuit which employs simple combinational logic and an updown counter circuit. Pitch period and voiced-unvoiced indication are determined from the location and magnitude of the peak value of the autocorrelation function. Additionally, a signal representative of the speech energy is provided by summing the digital speech signals over a predetermined time interval and intervals of silence are detected by comparing the speech energy in an interval of time with a predetermined or adaptively determined threshold energy.

35 Claims, 18 Drawing Figures

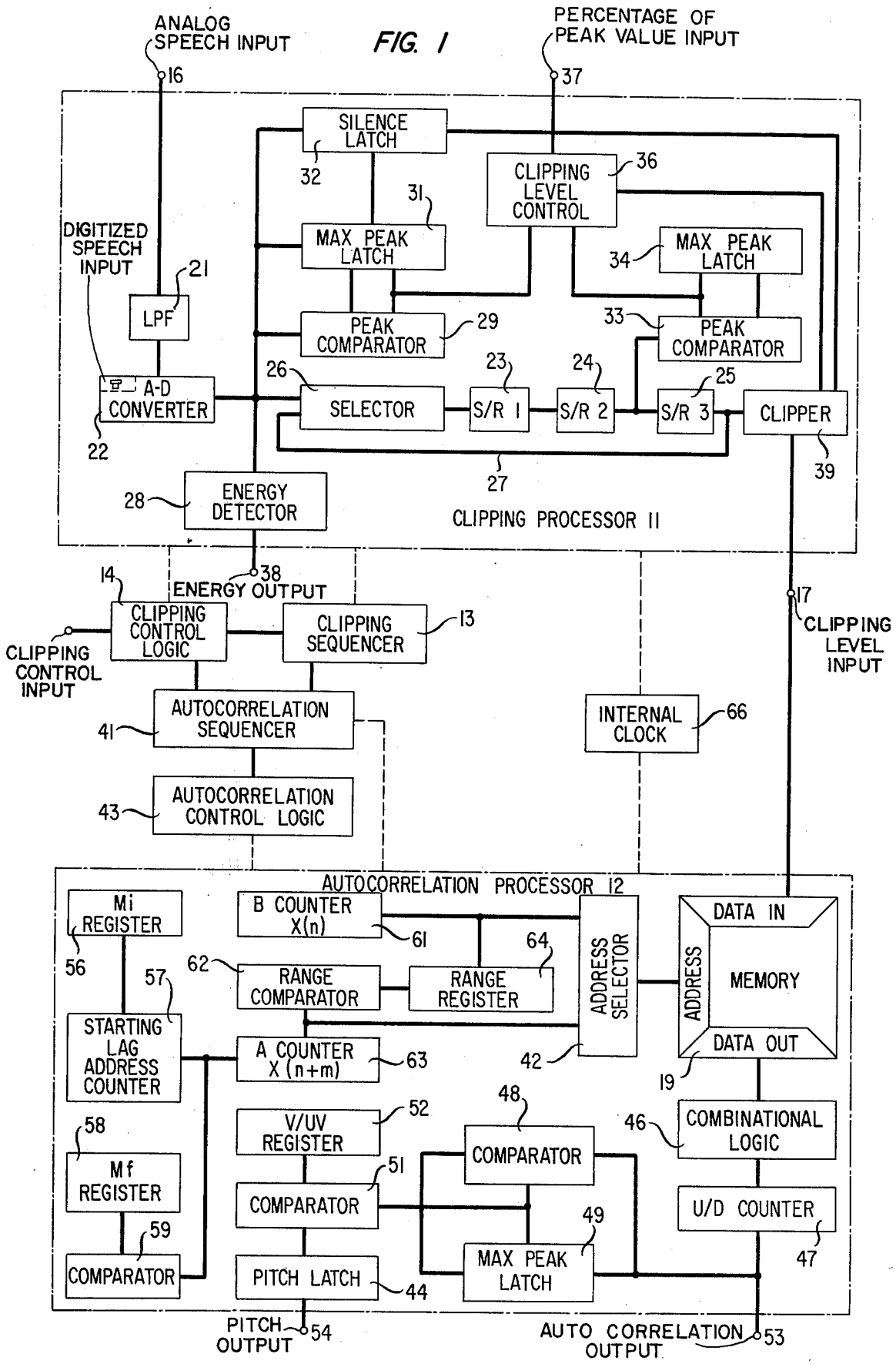
FIG. 1
ANALOG SPEECH INPUT
16
PERCENTAGE OF PEAK VALUE INPUT
37
SILENCE LATCH
32
CLIPPING LEVEL CONTROL
36
31
MAX PEAK LATCH
34
MAX PEAK LATCH
DIGITIZED SPEECH INPUT
21
LPF
PEAK COMPARATOR
29
33
PEAK COMPARATOR
26
23
24
25
A-D CONVERTER
SELECTOR
S/R 1
S/R 2
S/R 3
CLIPPER
22
27
39
28
ENERGY DETECTOR
CLIPPING PROCESSOR 11
14
38
ENERGY OUTPUT
17
CLIPPING LEVEL INPUT
CLIPPING CONTROL LOGIC
CLIPPING SEQUENCER
13
CLIPPING CONTROL INPUT
AUTOCORRELATION SEQUENCER
41
INTERNAL CLOCK
66
AUTOCORRELATION CONTROL LOGIC
43
AUTOCORRELATION PROCESSOR 12
Mi REGISTER
56
B COUNTER X(n)
61
64
DATA IN
MEMORY
DATA OUT
ADDRESS
ADDRESS SELECTOR
62
RANGE COMPARATOR
RANGE REGISTER
57
STARTING LAG ADDRESS COUNTER
A COUNTER X (n+m)
63
42
19
48
V/UV REGISTER
52
46
COMBINATIONAL LOGIC
58
Mf REGISTER
COMPARATOR
51
COMPARATOR
U/D COUNTER
49
59
47
COMPARATOR
PITCH LATCH
44
MAX PEAK LATCH
PITCH OUTPUT
54
AUTO CORRELATION OUTPUT
53

CLIPPING PROCESSOR

FIG. 12 CONTROL LOGIC CIRCUIT

REAL-TIME SPEECH ANALYZER

BACKGROUND OF THE INVENTION

This invention relates to the determination of speech parameters for use in speech processing systems. More particularly, this invention relates to the real-time determination of the pitch period, voiced-unvoiced determination, speech energy, and silence detection.

Speech analysis to determine speech parameters. such as pitch period or fundamental frequency, has become important in a number of situations. For example, in bandwidth compression communications systems, such as vocoders and linear predictive coding systems, speech parameters are encoded and transmitted in place of an electrical facsimile of the speech signal. In such a system, the original speech signal is synthesized from these parameters at the receiving station. Additionally, it has been found that the deaf can be trained to speak intelligibly by a system which visually displays the speech parameters of an instructor or recording in cojunction with the speech parameters of the handicapped person as he attempts to enunciate the same phrase. See, e.g., "Speech Processing Aids for the Deaf — An Overview," H. Levitt, *IEEE Transactions on Audio and Electronics*, Vol. AU-21, No. 3, pp. 269–273, June, 1973. Further, systems have been proposed for speaker indentification or speaker verification which identify or compare speech characteristics, rather than the more complex frequency pattern associated with speech. See, for example, "New Techniques for Automatic Speaker Verification, "A. Rosenberg and M. Sambur, *IEEE Transactions on Acoustics, Speech and Signal Processing*, Vol. AFFP-23, No. 2, Apr., 1975.

Since pitch period is one of the most important characteristics of speech, a number of speech analysis systems have been proposed for automatically measuring and presenting the pitch characteristics in an electrical format. Two such proposals which are relevant to the instant invention are described in M. M. Sondhi, U.S. Pat. No. 3,381,091, and E. E. David, Jr., et al, U.S. Pat. No. 3,405,237. In the Sondhi and David et al pitch analyzing systems, the resonances or formants which had previously prevented accurate determination of pitch information are suppressed by spectrally flattening the speech waveform and autocorrelating the spectrally flattened signal, following which the pitch signal is determined from the peaks in the autocorrelation function. In the David et al system, spectral flattening is achieved by dividing the speech into frequency bands and adjusting the signal amplitude within each band by automatic gain control or infinite clipping. In the Sondhi system, the formants are suppressed by so-called center-clipping in which oscillations that fall below a certain level are eliminated from the speech waveform.

Although each of these prior art systems often performs adequately, each system exhibits certain characteristics which limit its usage. One substantial limitation of both systems is that a large number of computational operations are necessary. Accordingly, both systems are generally realized by complex implementations which often include programmed digital computers. This computational and structural complexity has generally prevented the real-time determination of speech characteristics, thus usually precluding the application of such systems for on-line applications, such as speaker verification, real-time communications systems, and speech instruction equipment. Additionally, in the case of the David et al system, there are, in fact, certain cases in which the disclosed spectral flattening produces undesirable results. These cases occur when no pitch harmonic is contained within one of the apparatus' frequency bands, resulting in a low-level output from the bandpass filters associated with such frequency bands. This low-level signal tends to deteriorate rather than enhance the pitch detection process. In the Sondhi system, the clipping level is set at a predetermined percentage of the maximum absolute value of the waveform within a specific time interval. Since it is necessary to retain low-level voiced information, it has generally been necessary to set clipping level at a rather low percentage, with 30 percent often being used. Setting the clipping level at such a low value, however, does not provide the most advantageous degree of spectral flattening and can result in erroneous pitch indications.

Accordingly, it is an object of this invention to realize a speech analysis system which includes pitch detection and operates in real-time.

It is a further ojbect of this invention to realize a real-time pitch detector which additionally supplies a signal indicative of whether the applied speech signal is voiced or unvoiced, a signal indicative of whether a voice signal or silence is present, and a signal which indicates the total energy of the incident speech signal.

SUMMARY OF THE INVENTION

These and other objects are achieved, in accordance with this invention, by converting incident speech signals into a digital signal by sampling the analog signal at a predetermined rate and quantizing the resulting sampled signal. Specific analysis intervals are established by a signal which segments the speech signal into time intervals of predetermined duration, with each of the intervals containing a sub-interval common to the next-most antecedent interval and to the next-most subsequent interval. The sampled signals of each of these overlapping intervals are center-clipped and infinite peak-clipped to develop a digital signal which comprises three logic states, e.g., -1, 0, and +1, depending on whether the speech signal exceeds either the negative or positive clipping level or lies therebetween. The clipping level is dynamically determined on the basis of the magnitude of the speech signals within the subintervals of the predetermined signal interval which overlap the next-most antecedent and next-most analysis interval. Thus, as opposed to the prior art system described by the Sondhi patent, the clipping level is not based on the peak signal within the overall analysis interval, but is based on a predetermined relationship between the absolute peak levels of two discrete subintervals of the analysis interval. For example, in one embodiment of this invention the clipping level is established as a predetermined percentage of the smaller of the two peak levels. In this manner, the clipping level is adaptively maintained at the maximum value which ensures that intervals of low-level speech are detected.

The center-clipping-infinite-peak clipping signal processing described above advantageously reduces the computational complexity of the autocorrelation determination. Specifically, in accordance with this invention, the autocorrelation function is determined by simple combinational logic which does not require either multiplication or addition of the clipped speech signals. More specifically, in accordance with one embodiment of this invention, the autocorrelation function is determined by a relatively simple logic circuit which detects the logic state of each signal sample in the pair of signal samples which are normally multiplied to form the autocorrelation function and accumulates the resulting logic signal in an up-down counter circuit. The combinational, logic and the up-down counter calculate individual terms of the autocorrelation function at predetermined lag elements of a predetermined lag range which is of sufficient length to include normal speech pitch periods. The location and value of the peak value of the autocorrelation function are determined by continuously comparing the value of the autocorrelation function at the lag element currently being calculated with the maximum value of the autocorrelation function at the previously calculated lag elements. The value and location of the autocorrelation peak are used to determine the voiced-parameter and pitch period.

The real-time development of the signal autocorrelation function, and hence the speech pitch period, is facilitated by dividing the processing circuitry of the instant invention into two parallel processing paths. The first processor circuit performs the adaptive clipping operation and also determines the energy level of each sub-interval of processed speech. The second processor circuit computes the autocorrelation function, determines the pitch period from the calculated autocorrelation function, and also determines whether the speech signal is voiced or unvoiced. The temporal relationship between these two processors is such that, while the first processor operates on the speech samples of a first analysis interval, the second processor simultaneously operates on the data processed by the first processor during the next-most antecedent analysis interval.

In accordance with this invention, the speech energy within each sub-interval of the main processing interval is detected by a circuit within the first processor unit which sums the absolute value of the speech samples. The summation circuit provides an output signal which indicates the time-varying energy level of the incident speech signal. Further various embodiments of the present invention include means within the first processor unit for detecting intervals of silence by comparing the peak signal levels within each speech interval with a threshold signal. The silence threshold signal can be a fixed value determined on the basis of the particular environment in which the invention is to operate, or the threshold signal can be dynamically determined during a "training interval" in which the invention is generally subjected only to background noise. In any case, the silence threshold is generally stored in a register and compared with the peak signal level of each processed speech interval. If the peak level is below the silence threshold, that particular time interval is classified as silence, and computation of the pitch period for that time interval can be suppressed. It will be recognized by those skilled in the art that suppression of pitch period signal during silence intevals is especially advantageous in application of this invention to speech communication. For example, when the invention is utilized in a communications system, in a speaker identification or in a speaker verification system which operates over conventional telephone lines, background noise can thereby be suppressed. Such suppression results in substantially noise-free simulation of voice signal in the receiving apparatus of a communications system, or eliminates spurious signals which could cause erroneous indication in speaker identification and verification systems.

Voiced-unvoiced determination is achieved within the second processor circuit of this invention by a circuit which compares the amplitude of the maximum value of the autocorrelation function within the predetermined lag range with a predetermined threshold value. If the resultant value is greater than a predetermined threshold value, the speech signal during that interval of time is classified as voiced speech. A suitable voiced-unvoiced threshold may be established by a variety of techniques, with the threshold usually being based on the calculated autocorrelation function. For example, in one embodiment of this invention, the voiced-unvoiced threshold is established as a percentage of the value of the speech autocorrelation function at the zero lag element.

BRIEF DESCRIPTION OF THE DRAWINGS

FIG. 1 depicts, in block diagram form, a speech analysis system which illustrates the broader aspects of our invention;

DETAILED DESCRIPTION

Figure 2:
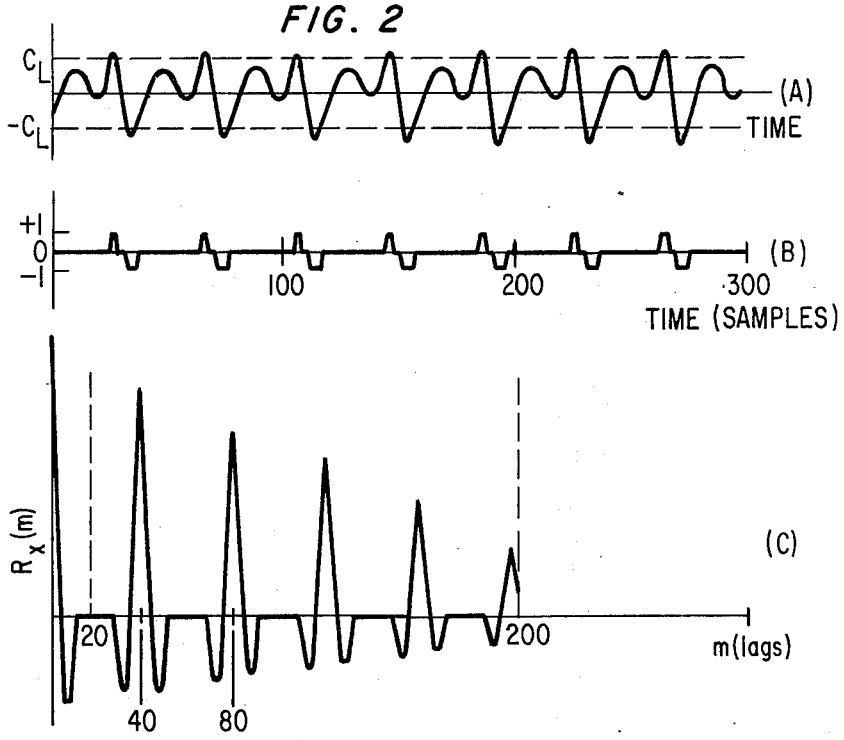
FIG. 2 illustrates a typical speech interval processed in the practice of this invention and depicts the corresponding output signals obtained with this invention.

FIG. 1 is a block diagram depicting the broader aspects of our invention. The speech analyzer of FIG. 1 basically comprises clipping processor 11, autocorrelation processor 12, clipping sequencer 13, clipping control logic 14, autocorrelation sequencer 41, autocorrelation control logic 43, and master clock 66. As will be described in detail in the discussion of FIG. 1 and the discussion of FIGS. 4–18, which depict an illustrative embodiment of this invention, sequencers 13 and 41, in conjunction with control logic circuits 14 and 43, provide the control signals which maintain the timing of circuit operations within processors 11 and 12.

Clipping processor 11, responsive to a speech signal applied to input terminal 16, produces a digital signal at terminal 17, which is indicative of whether a particular speech sample exceeds either the negative or positive clipping level or falls therebetween. As shall be described, the clipping level is dynamically controlled during the speech analysis, being adjusted on the basis of the speech sample signals processed during any given interval of time. The digital signals developed by processor 11 during each particular analysis interval are stored in memory 19 of autocorrelation processor 12. Autocorrelation processor 12 determines the autocorrelation function of the sampled speech signal over a predetermined lag range and determines the pitch period from the location of the largest autocorrelation peak. Although under the basic control of clipping squencer 13 and clipping control logic 14, autocorrelation processor 12 operates independently of clipping processor 11 in that, while processor 11 operates on the speech samples of a particular analysis interval, processor 12 (under the control of autocorrelation sequencer 41 and autocorrelation control logic 43) simultaneously operates on the digital output signals of processor 11 which resulted from the next-most previous analysis interval.

The operation of the speech analyzer of FIG. 1 is best understood by assuming that the system has been in operation for a period of time and the analysis of a particular interval of speech is about to begin. The speech signal applied to terminal 16 is low-pass filtered by filter 21, which may be any conventional filter circuit with a bandpass suitable for passing the frequencies of interest. Analog-to-digital (A-D) converter 22, which is connected to the output terminal of filter 21, may be any conventional circuit which produces the desired quantization levels and sampling rate. The output of converter 22 is a plurality of digital words, with each digital word representing a sample of the speech signal. Since the system has been in operation, shift registers 23, 24, and 25 each contains a predetermined number of digital speech samples, with each shift register generally holding an equal number of data words. Since the speech samples were applied to the input terminal of shift register 23 as they become available from A-D converter 22, the information contained in shift registers 23, 24, and 25 is effectively a history of the speech signal over the previous predetermined analysis interval, with each shift register containing digital data representing a predetermined sub-interval of the particular analysis interval utilized. For example, as shall be discussed in an illustrative embodiment of this invention depicted in FIG. 4, one satisfactory arrangement is to utilize a 10 kHz speech sampling rate, with each shift register holding 100 digital words. Thus, in this embodiment clipping processor 11 contains a 30-millisecond speech interval, with shift register 23 holding the latest 10 milliseconds of speech and shift registers 24 and 25 each containing 10 milliseconds of speech information for the two next-most antecedent 10-millisecond time intervals.

At the conclusion of the clipping process for the information in shift registers 23, 24, and 25, sequencer 13 and control logic 14 initialize the system for the loading of the next speech subinterval. For example, in the previously referred to embodiment, a 10-millisecond speech interval is loaded. The details of this initialization process will be discussed hereinafter with respect to the illustrative embodiment of FIG. 4. At this point, it is sufficient to realize that during this initialization sequencer 13 and control logic 14 activate selector circuit 26 to complete a circuit path between A-D converter 22 and shift register 23. Selector 26 is a conventional digital selector circuit which effectively operates as a switch. In FIG. 1, selector 26 operates under the control the sequencer 13 and control logic 14 to connect the input terminal of shift register 23 to the output terminal of A-D converter 22 or to the data recirculate path 27. With selector 26 activated to connect shift register 23 to A-D converter 22, speech samples are sequentially coupled to the input of shift register 23 as they become available from A-D converter 22. As each data word is coupled to shift register 23, shift registers 23, 24, and 25 are each strobed by a control signal derived from master clock 66 to advance the samples stored within the shift registers by one location. It will be noted that each digital word or speech sample entering shift register 23 is also coupled to energy detector 28, peak comparator 29, maximum peak latch 31, and silence level latch 32.

Energy detector 28 determines the energy of the speech sub-interval being loaded as each speech sample is coupled to shift register 23. Since the energy can be expressed as $$E = \sum_{n=0}^{k} |x(n)| \tag{1}$$

where $k$ is equal to the number of speech samples in the analysis sub-interval and $|x(n)|$ denotes the absolute value of the $n^{th}$ speech sample. Energy detector 28 generally includes a conventional digital accumulator circuit which can be initialized to zero after the processing of the speech samples of the processed time interval. Thus, it can be realized that in the previously referred to embodiment in which one hundred speech samples representing 10 milliseconds of speech are sequentially loaded in shift register 23, energy detector 28 will contain the energy of the 10-millisecond sub-interval when the last speech sample of the sub-interval is loaded into shift register 23.

As speech data are being loaded into shift register 23, peak comparator 29 and maximum peak latch 31 are simultaneously receiving each data word. Comparator 29 is a conventional digital comparator circuit which compares the value of each incoming digital word with the value contained in maximum peak latch 31. Each time the incoming data word is larger than the data word stored in maximum peak latch 31, comparator 29 strobes latch 31 to load the incoming data word into latch 31. Thus, as each data word is loaded into shift register 23, latch 31 contains the data word representing the maximum speech amplitude of the samples which have been previously loaded into shift register 23. Accordingly, when the data words of the processing sub-interval have all been loaded into shift register 23, data latch 31 holds the value of the maximum speech signal within the sub-interval contained in shift register 23. Maximum peak latch 31 is cleared prior to the arrival of the first data word of each speech sub-interval so that the initial incoming data word is compared with zero.

It can be noted in FIG. 1 that peak comparator 33 and maximum peak latch 34 are interconnected in the same manner as comparator 29 and latch 31, with one input of comparator 33 connected to the data line which carries data between shift registers 24 and 25. Comparator 33 and latch 34 operate in the same manner as comparator 29 and latch 31. Since one input to comparator 33 is the data transferred between shift registers 24 and 25, it will be realized that when shift register 23 has been loaded with the speech data of the new interval to be processed, latch 34 will hold a data word corresponding to the maximum speech sample for that speech sub-interval held in shift register 25. For example, in the previously referred to embodiment, shift registers 23, 24, and 25 hold the most recent 30 milliseconds of speech information, with maximum peak latch 31 holding the peak value of the first-most antecedent 10 millisecond interval and peak latch 34 holding the maximum speech value which occured in the time interval 20 to 30 milliseconds prior to the first speech sample of shift register 23.

When the last data word of the speech interval to be processed has entered shift register 23, sequencer circuit 13 generates a pulse which signals clipping processer 11 to determine the clipping level to be utilized during the clipping operation. In addition, energy detector 28 is generally strobed at this time and the digital word representing the energy of the speech signal stored in shift register 23 is transmitted to energy output terminal 38. The transfer of the energy signal to terminal 38 simultaneously clears energy detector 28 for the detection of the energy of the next processing sub-interval. Thus, in terms of the previously referred to embodiment, it can be seen that an energy signal is generally transmitted to terminal 38 every 10 milliseconds, and accordingly, the signal at terminal 38 is representative of the time varying speech energy. If an analog output signal is desired, a conventional digital-to-analog converter may be employed between energy detector 28 and output terminal 38 (not shown in FIG. 1).

The clipping level to be utilized by clipping processor 11, when the data words contained in shift registers 23, 24, and 25 are processed by clipper circuit 39, is established by clipping level control 36. Clipping level control 36 selects the lesser of the two data words stored in maximum peak latches 31 and 34. A conventional comparator circuit is generally employed to select this minimum peak value. The selected peak value is then multiplied by the percentage of peak value which is applied to terminal 37. Generally, the percentage of peak value is a parameter selected by the operator to suit the conditions of the speech analysis being performed. Any convenient method of preserving the percentage of peak value parameter may be employed. For example, a conventional storage register may be utilized wherein a digital word representing the parameter may be supplied to clipping level control circuit 36.

It will be realized by those skilled in the art that a multiplication operation is generally more time consuming than the operation of addition. Accordingly, to facilitate real-time operation, the multiplication performed by clipping level 36 is preferably performed with the shift-and-add technique of the illustrative embodiment of clipping processor 11 depicted in FIG. 4 and discussed hereinafter.

Upon the determination of the clipping level, sequencer 13 generates a signal which causes clipper circuit 39 of clipping processor 11 to operate on the data stored in shift registers 23, 24, and 25. This signal operates selector 26 to complete recirculate path 27 so that the data words recirculate through the shift registers during the clipping operation. Further, during the clipping operation, contol logic 14 provides a number of clock pulses (derived from master clock 66) equal to the number of speech samples stored in the shift register. Thus, the data signals are sequentially coupled to clipper 39 and recirculated within the shift registers. Clipper 39 compares each data sample coupled from the shift registers with the clipping level established by clipping level control 36 and also compares each arriving data sample with the silence level threshold contained in silence level latch 32.

Silence latch 32 contains a digital word which represents the signal level which must be exceeded before a signal will be recognized as speech. This threshold may be a predetermined quantity which is either a fixed constant or a constant which is under the control of the operator, in which case silence latch 32 may be a conventional storage register. On the other hand, as will be discussed with respect to the clipping processor embodiment of FIG. 4, the silence threshold may be adaptably determined either during an initial training period (e.g., an initial time interval at the beginning of each particular speech processing operation) or at any time the operator so desires. In any case, clipping circuit 39 generally includes a comparator circuit to determine whether each arriving data word exceeds the silence threshold. Simultaneously, each arriving data word is applied to a second comparator within clipper 39 to determine whether the magnitude of the arriving data word is greater than the clipping level established by clipping level control 36.

Figure 13:
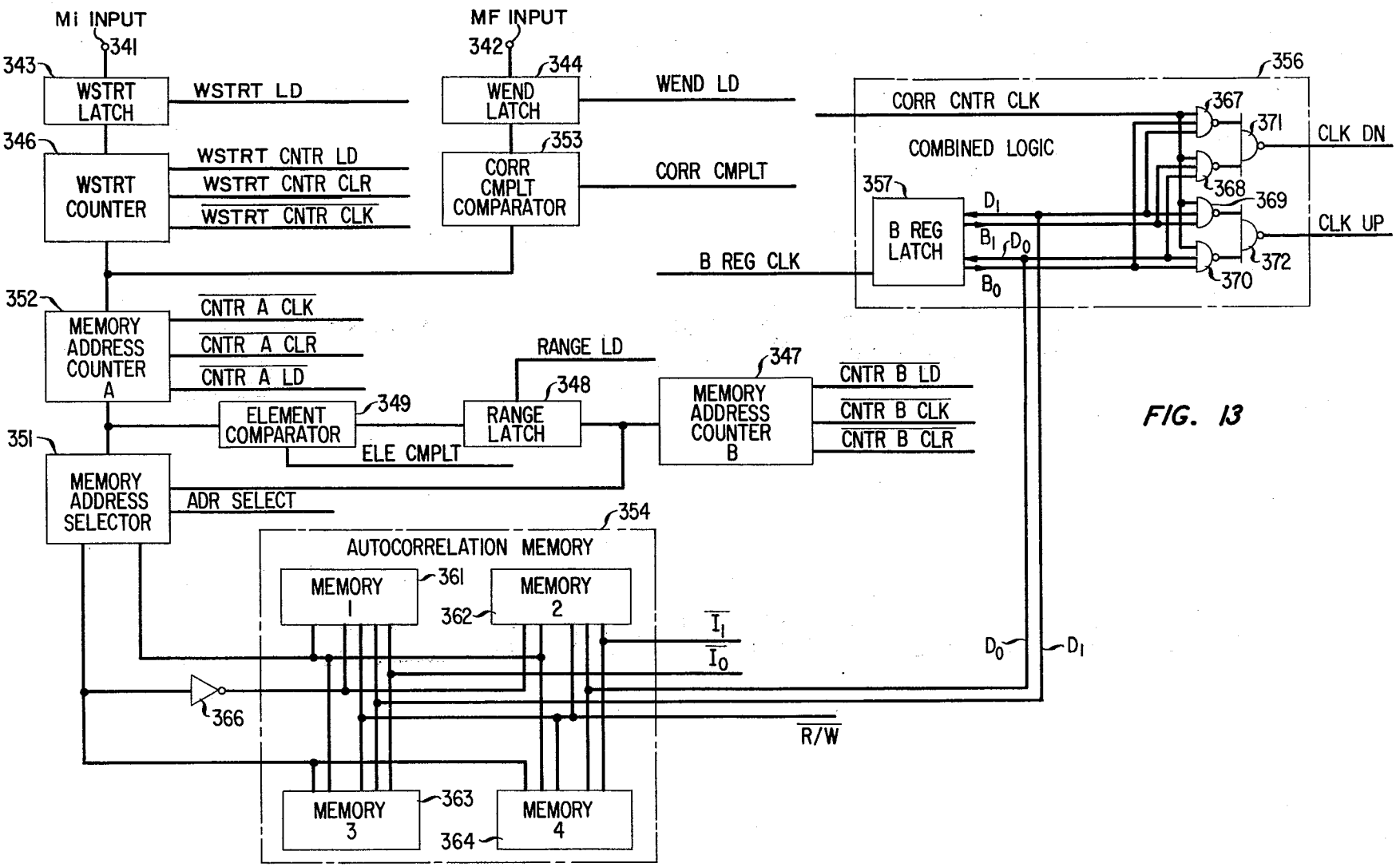
FIG. 13 schematically illustrates an embodiment of the memory circuit, the circuitry for addressing the memory circuit and the combinational logic utilized in the illustrative embodiment of this invention.

There are three conditions resulting from the two comparator outputs which are of interest in the practice of this invention. First, if the magnitude of the arriving data word is less than either the silence threshold or the clipping level, the output of clipper 39 will assume a first value which may be conveniently indentified as a logical 0 state. The second and third conditions occur when the arriving data signal is of greater magnitude than the silence threshold and of greater magnitude than the clipping level. Under this condition, if the incoming signal is negative (as determined by the sign bit of the incoming data word), clipper 39 generates a signal which may conveniently be denoted by a logical −1 state. Similarly, if the incoming data word is positive, clipper 39 generates a signal which may be conveniently identified as a logical +1 state. This relationship is illustrated in FIGS. 2A and 2B, which depict a typical speech analysis interval and the corresponding output of clipper 39, respectively. As can be observed in FIG. 2B, with the above-described operation, the output signal of clipper 39 is effectively a center-clipped and infinitely peak-clipped version of the speech input signal. To facilitate processing the clipped signals in autocorrelation processor 13, the output states are generally converted to a 2-bit digital word by appropriate coding circuitry within clipper 39. An embodiment of a suitable coding circuit is included in the discussion of the illustrative embodiment of this invention (FIG. 13).

As clipper circuit 39 operates on each data word stored in shift registers 23, 24, and 25, the resulting coded signal is transferred to memory unit 19 of autocorrelation processor 12, where it is stored until the autocorrelation computation for that analysis interval begins. It may be observed that as the last data word is processed by clipper 39, the shift registers contain the original data words stored in the same sequence as when the clipping operation began. At this time, selector 26 is activated by sequencer 13 to connect shift register 23 to A-D converter 22, and clipping processor 11 is ready to accept the next sub-interval of speech signals as the data words arrive from A-D converter 22. For example, in the previously referred to embodiment, processor 11 is now ready to load the next 100 data words which represent the next 10 milliseconds of speech.

As was previously discussed, the silence threshold established by silence latch 32 may be adaptively determined. One method of adaptively establishing this threshold is to determine the energy level during a period of silence or background noise which may be at the beginning of the speech analysis, i.e., a training period, or at any time the speech analyzer operator desires. In accordance with one embodiment of this invention, the adaptive silence threshold is determined in the same general manner as the peak level is determined during the processing of speech samples. More specifically, a predetermined number of speech samples representing the background noise or silence are processed, with peak comparator 29 and maximum peak latch 31 determining the data word having the maximum magnitude during the silence period. When the last data word of the silence interval has been shifted into shift register 23, the digital word held in maximum peak latch 31 is transferred to silence level latch 32 by a strobe signal generated by control logic 14. Circuitry for effecting this method of determining the silence threshold will be discussed in connection with the illustrative embodiment of this invention which provides for a 512 sample silence training period. Other alternative methods of establishing the silence threshold will also become apparent to those skilled in the art. For example, for many applications it may be satisfactory to utilize the most significiant bit of the maximum data word held in maximum peak latch 31 at the conclusion of loading data words of a new speech sub-interval as the silence threshold. Still another alternative basis the silence threshold upon a measurement of the average speech energy.

Autocorrelation processor 12 computes the autocorrelation function over a present lag range, and, as previously noted, autocorrelation processor 12 operates on clipped data signals which were supplied by clipping processor 11 during the previous speech analysis interval. For example, in the previously referred to embodiment, 300 data words representing the clipped speech samples have been transferred to memory 13 at the end of a particular processing interval. Once the clipping process is complete, clipping processor 11 acccepts 100 new data samples and begins to generate a new block of 300 clipped data words. While clipping processor 11 determines the new 300 data words, autocorrelation processor 12 determines the autocorrelation function for the 30 millisecond analysis interval stored in memory 19, determines whether the speech signal is voiced or unvoiced in this time interval and, if voiced, indicates the pitch period.

As is known in the art, the value of the autocorrelation function of the sampled signal at the mth lag may be expressed as:

$$R_x(m) = \sum_{n=O}^{N-m-1} x(n)\, x(n+m), \qquad m = M_i, M_i+1, \ldots M_f \tag{2}$$

where N is the number of data words in the processed speech interval, i.e., the total number of data words which were processed by clipping processor 11 and stored in memory 19 of autocorrelation processor 12; $m$ is a particular lag element of the autocorrelation computation; $x(n)$ and $x(n+m)$ are the data words representing the nth and $(n+m)$th speech sample of the processed interval; and $M_i$ and $M_f$ are respectively the initial and final lag which define the lag range over which the autocorrelation is to be computed. In the practice of this invention, typical values of $M_i$ and $M_f$ are 25 and 200, respectively, which enable autocorrelation processor 12 to detect pitch frequency in the range 400 Hertz to 50 Hertz.

In the practice of our invention, however, it can be recognized that, because of the clipping operation of clipping processor 11, each data signal to be processed by autocorrelation processor 12 corresponds to one of three logic states, i.e., $-1, 0, +1$. Accordingly, it can observed that since the individual product terms of Equation (2) are of the form $x(n)\ x(n+m)$ then each product of the correlation computation can only assume the following values.

$$x(n)\ x(n+m) = 0 \text{ if } x(n) \text{ or } x(n+l) = 0 = 1 \text{ if } x(n)=x(n+m)=1=-1 \text{ if } x(n)=-x(n+m)=\pm 1 \tag{3}$$

Thus it can be realized that in the practice of this invention relatively simple combinational logic can be utilized to perform what would be a time consuming multiplication and summation operation in conventional autocorrelation apparatus.

Figure 11:
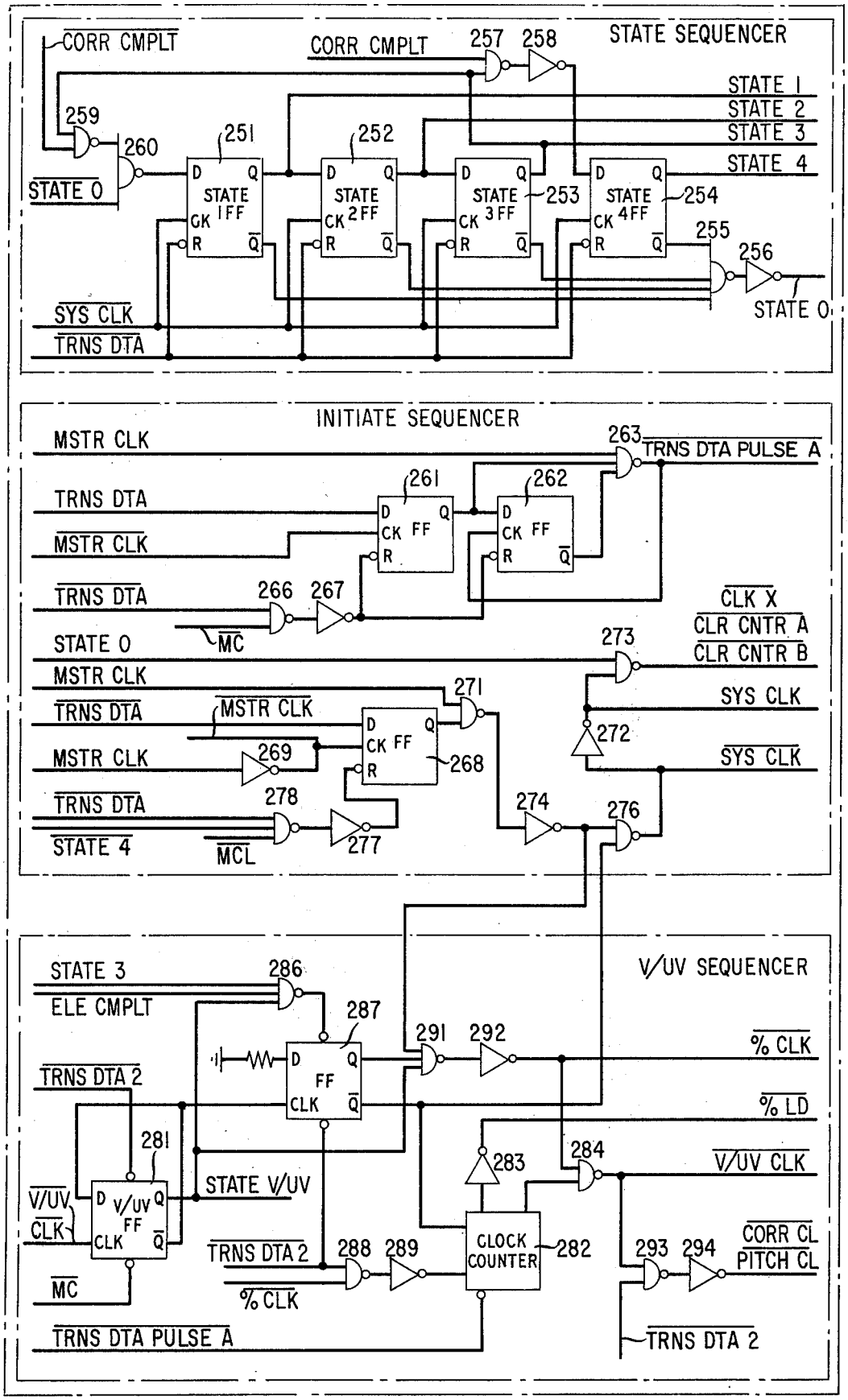
FIG. 11 depicts a sequencer circuit suitable for generating the sequence control signals of FIG. 10 for operating the autocorrelation processor of the illustrated embodiment of this invention.

Prior to the beginning of the calculation process for any given speech interval, autocorrelation processor 12 is initialized by autocorrelation sequencer 41. The initialization process includes four operations. The first operation is the loading of memory 19 with the data words produced by clipper 39 of clipping processor 11. As previously discussed, this loading operation occurs during the operation of clipper circuit 39. During this loading process, address selector 42 writes each data word into storage locations of memory 19 and when the final data word is entered in memory 19 address selector 42 is set to access the data word required in the first step of the calculation sequence. The second initialization operation is the clearing of pitch latch circuit 44 by transfering the signal held in the pitch latch to pitch output terminal 54. This signal represents the pitch period of the time interval processed by autocorrelation processor 12 during the preceding calculation sequence. For example, in the depicted autocorrelation function of FIG. 2C, it can be recognized that the maximum autocorrelation peak occurs at approximately lag element 40 which in the case of data sampled at a 10 kilohertz rate corresponds to a pitch period of 4 milliseconds or a pitch frequency of 250 Hertz. The third initialization operation is the clearing of max peak latch circuit 49 by transferring the data held in the latch to autocorrelation output terminal 53. This signal represents the amplitude of the maximum peak in the autocorrelation function of the preceding calculation sequence. The fourth initialization operation is the loading of the starting lag address in counter 57 and the resetting of counters 61 and 63. A circuit which is suitable for performing this initialization process is illustrated in FIG. 11 and will be discussed with respect to the illustrative embodiment of this invention.

During operation of autocorrelation processor 12 counter 63 and counter 61 control address selector 42 so that the required data words $x(n)$ and $x(n+m)$ are transferred from memory 19 to combinational logic 46. For example, when the processing of the interval of speech data begins $m$ is equal to the initial lag $M_i$ and starting address counter 57 accesses the value $M_i$ which is stored in $M_i$ register 56, loads counter A with the address of $x(m_i)$ while counter B simultaneously causes address selector 42 to access data word $x(O)$. The data words $x(M_i)$ and $x(O)$ are transferred to combinational logic 46, which as previously described determines whether up-down counter 47 is to be updated by counting up or down by one count. Both counters 61 and 63 which are conventional counter circuits which are then incremented by one count by each clock pulse of a control signal derived from master clock 66. With each data access of memory 19, i.e., each clock pulse from master clock 66, combinational logic 46 controls U/D counter 47 to accumulate a count which is representative of the autocorrelation function at lag $M_i$. As the calculation of lag element $M_i$ process proceeds, i.e., as data words $x(n)$ and $x(M_i+n)$ for $n=0\ 1, 2, \ldots, N\text{-}M_i$ are transferred to combinational logic 46 for the corresponding control of U/D counter 47, the count reached by counter 63 is compared with the data range stored in range register 64 (which may be any conventional storage device) by range comparator 62. Range comparator 62, which is a conventional comparator circuit, generates a "correlation element complete" signal when counter 63 causes the transfer of $x(N\text{-}M_i)$ to combinational logic 46. At this point U/D counter 47 holds the value of the autocorrelation function at lag element $M_i$.

After the calculation of the autocorrelation function at lag $M_i$, starting address counter 57 is incremented to the next lag element and the process repeats. This process continues with the autocorrelation computed for each of the desired lag elements. The calculation of the autocorrelation function at the final lag element $M_f$ is detected by comparator circuit 59 which compares the value stored in $M_f$ register 58 with the incremented count of starting address counter 57.

The magnitude of the autocorrelation function at each particular lag element is coupled to comparator 48 which is a conventional digital comparator circuit capable of handling the digital format employed in any particular embodiment. Comparator 48 compares the value of the autocorrelation function computed for a particular lag element with the value contained in max peak latch 49. If the value of the autocorrelation function transferred from the U/D counter 47 is greater than the value stored in peak latch 49, comparator 48 transfers the new larger value into latch 49 and pitch latch 44 is activated to store the address of that particular lag element. Since max peak latch 49 was cleared during the initialization process, it can be observed that the first calculation sequence which calculates $R_x(M_i)$ results in the value of $R_x(M_i)$ being stored in peak latch 49 and the address of $M_i$ being held in pitch latch 44. Thereafter, with the calculation at each lag element max peak latch 49 will hold the maximum value of the autocorrelation function of the previously computed lag elements and pitch latch 44 will contain the address of the lag at which this peak occurred. Thus upon conclusion of computing the entire autocorrelation function, i.e., computing the autocorrelation value at each desired lag within the range $M_i$ to $M_f$, max peak latch 49 will contain the value of the autocorrelation function peak and peak latch 44 will contain the address of the lag at which the peak occurred. Since the address of the autocorrelation peak is effectively the location of the peak value this quantity corresponds to the pitch period.

The output terminal of U/D counter 47 is also coupled to autocorrelation output terminal 53 to provide an output signal representative of the autocorrelation function of the processed speech interval. A typical autocorrelation signal output is depicted in FIG. 2 which illustrates a processed interval of typical speech, the corresponding clipped signal produced by clipping processor 11 and the autocorrelation function $R_x(m)$, developed from this clipped signal by autocorrelation processor 12. Examining the autocorrelation signal $R_x(m)$ in FIG. 2C, it can be noted that the autocorrelation function is effectively weighted by a linear taper such that the autocorrelation peaks decrease as the lag element $m$ increases. This taper results since the computational process of autocorrelation processor 12 effectively assumes that the speech samples outside the analysis interval are equal to zero. This linear taper enhances the operation of our invention in that the first autocorrelation peak, which determines the pitch period, is effectively emphasized with respect to autocorrelation peaks occurring at multiples of the pitch period. Accordingly, in comparison with prior art devices, there is far less likelihood of pitch detection error in which a multiple of the true pitch period is indicated.

The voiced/unvoiced (V/UV) circuitry of FIG. 1 which includes V/UV register 52, pitch latch 44, and comparator 51 supresses the pitch signal output if the calculated amplitude of the peak of the autocorrelation function does not exceed a predetermined threshold. This threshold, which is stored in V/UV threshold register 52, may be adaptively determined on the basis of the processed speech signal or may be a fixed value selected for any particular embodiment. A circuit for establishing the V/UV threshold on the basis of the value of the autocorrelation function at zero lag is described in the discussion of the illustrative embodiment of this invention. In any case, comparator 51 which is a conventional comparator circuit compares the autocorrelation value contained in max peak latch 49 with the value stored in V/UV register 52. If the value of the autocorrelation function does not exceed the U/UV threshold, pitch latch 44 (which contains the pitch period information) is cleared thereby suppressing the output of a pitch signal during unvoiced speech intervals.

AN ILLUSTRATIVE EMBODIMENT

The following discussion pertains to one particular embodiment of our invention. As previously stated, this embodiment operates at a speech sampling rate of 10 kHz, with clipping processor 11 of FIG. 1 operating on a 30 millisecond speech interval which is updated each 10 milliseconds with the latest 100 speech samples. In one realization of this embodiment, 12-bit (11-bit plus sign bit) A-to-D conversion of the speech signal is utilized, all 11 bits being used to determine speech energy and clipping level and the 8 most significant bits being used to produce the clipped speech signal. Each of the components, e.g., shift registers, gates, latches, and selectors, utilized in this embodiment are commercially available devices.

It will be apparent to the skilled artisan upon understanding the speech analysis circuit of FIG. 1 that a variety of circuit implementations may be employed to practice this invention. The discussion of the following embodiment should therefore not be interpreted as limiting our invention, but rather the purpose in disclosing the illustrative embodiment is twofold. First, this illustrative embodiment has proven to perform real-time speech analysis in a manner which appears suitable for a wide range of present-day and forseeable future applications. Secondly, the disclosure of this illustrative embodiment is intended to provide more specific temporal relationships between the various circuit operations which enhance the real-time operation. Upon understanding these temporal relationships many variations and implementations of our invention will be apparent.

For the discussion of the illustrative embodiment, it is convenient to treat that portion of the embodiment which corresponds to clipping processor 11 in FIG. 1 separately from that portion of the circuit which corresponds to autocorrelation processor 12 of FIG. 1. It will be realized, of course, that the described clipping processor and autocorrelation processor operate in the same manner as discussed with respect to the embodiment of FIG. 1. That is, while the clipping processor operates on speech samples of any particular processing interval, the autocorrelation processor is simultaneously operating on the clipped output signal supplied by the clipping processor during the previous analysis interval.

OPERATIONAL SEQUENCE OF THE CLIPPING PROCESSOR

The operating sequence of the clipping processor of this embodiment includes four distinct operating states. During the first state hereinafter denoted "state O" the speech samples are loaded into the clipping processor shift register circuitry (e.g., shift registers 23, 24, and 25 of FIG. 1). As previously described in conjunction with the circuit of FIG. 1, this loading process consists of updating the shift register circuitry with 100 speech samples (10 milliseconds of speech) as the speech samples become available. As the 100 samples are loaded, the clipping processor determines the energy level of the 10 millisecond update interval and determines the peak speech sample within the first and third 10 millisecond sub-interval of the 30 millisecond speech analysis, interval. During the second operational state, hereinafter denoted "state 1" the speech energy level determined in state 0 is loaded into a latch circuit to provide a digital output signal representative of the time varying speech energy. In state 1, the smaller of the two peak speech samples determined in state 0 is also detected and utilized in conjunction with the predetermined percentage of clipping level parameter to establish the clipping level. During the third processor state, hereinafter identified as "state 2", 300 two-bit data words which are representative of the clipped speech data are generated by the clipper circuit (e.g., clipper 39 of FIG. 1) and are transferred to the autocorrelation processor. At the conclusion of state 2 the clipping processor automatically reverts to state 0 to begin the processing of the next speech analysis interval. The fourth processor state, hereinafter denoted as "state 3", may be initiated at any desired time to adaptively determine the silence threshold level discussed in connection with the circuit of FIG. 1. During this state, 512 successive data words, are loaded into the clipping processor. These samples are normally loaded with ambient background noise as the speech analyzer input signal. At the conclusion of state 3 the maximum peak determination circuit (which is utilized in state 0 to determine the peak speech sample of the latest 100 data words stored in the shift register) contains the peak sample of the "silent" period. This peak value is strobed into the silence latch (e.g., latch 32 of FIG. 1) for use by the clipper circuit (e.g., clipper 39 of FIG. 1) in the determination of the clipped speech signal. At the conclusion of state 3 the clipping processor sequence reverts to state state 0 and the clipping processor cycles through state 0 through 3 to process each interval of the incoming speech signal.

Figure 3:
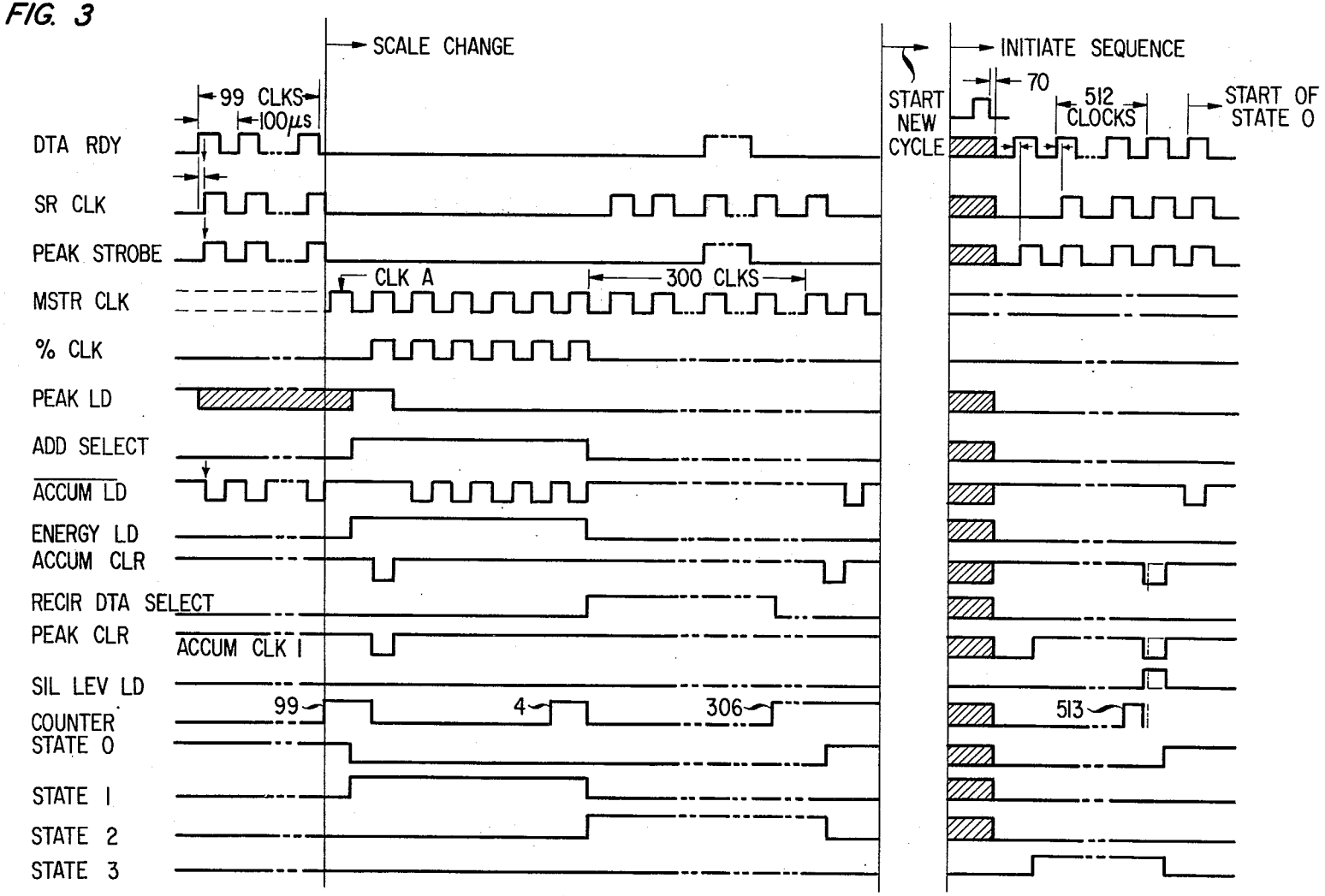
FIG. 3 depicts a timing and sequence diagram of the clipping processor of an illustrative embodiment of this invention.

FIG. 3 depicts the clipping processor state sequence signals (i.e., state 0, state 1, state 2 and state 3). In addition, FIG. 3 depicts each of the signals which control the operation of the clipping processor embodiment of FIG. 4 during each of the operational states. The function of each signal will be apparent upon understanding the discussion of the circuit embodiment of FIG. 4 and the discussion of the sequencer circuit of FIG. 7 in conjunction with the logic control circuit of FIG. 9. It is important to realize, however, that FIG. 3 is effectively a timing diagram which reveals the operational sequencing of the clipping processor embodiment of FIG. 4.

OPERATION OF THE CLIPPING PROCESSOR OF FIG. 4

Figure 9:
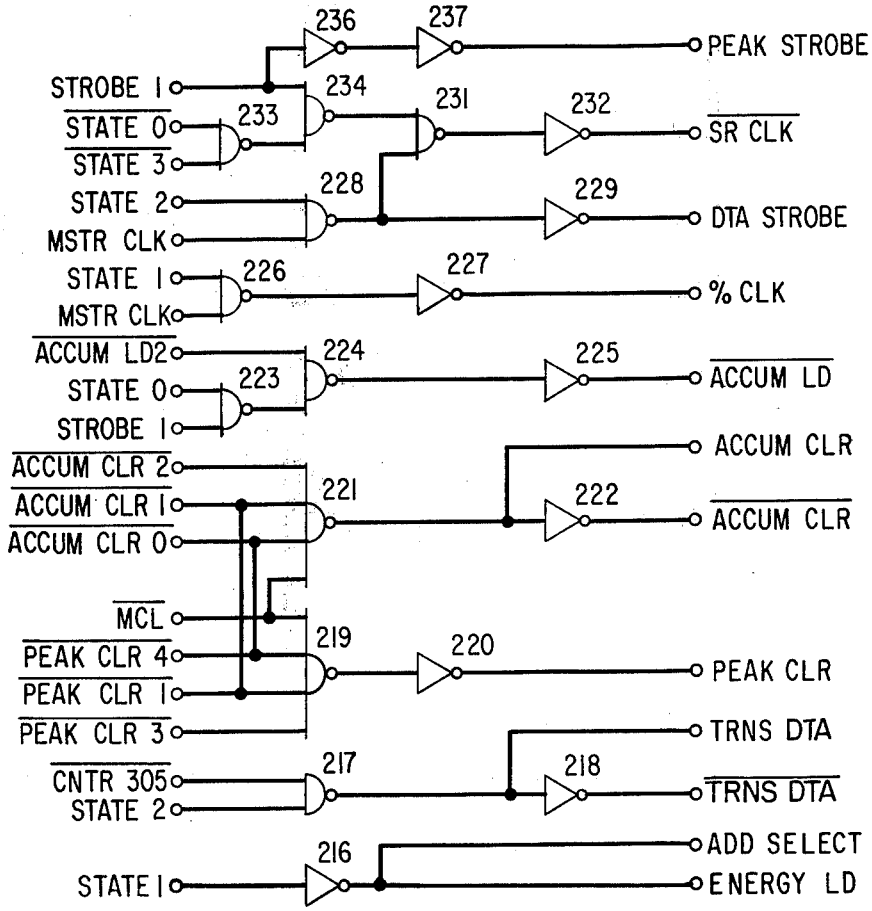
FIG. 9 schematically depicts control gating logic circuitry suitable for generating the control signals which operate the clipping processor of FIG. 4.
Figure 4:
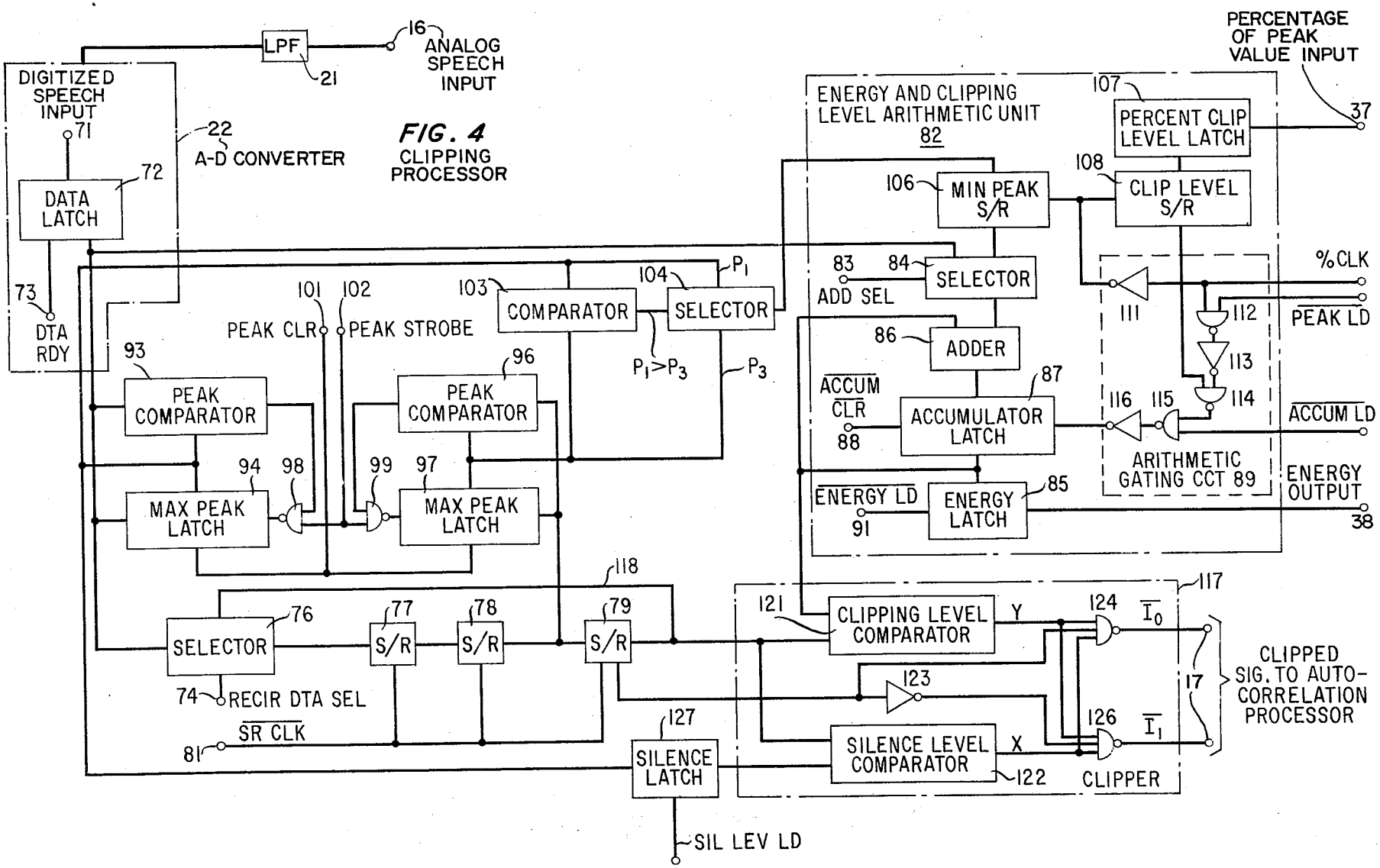
FIG. 4 illustrates the clipping processor portion of an illustrative embodiment of this invention.

FIG. 4 depicts the circuit arrangement of that portion of the illustrative embodiment which consitutes clipping processor 11 of the speech analysis system of FIG. 1. Elements corresponding to low pass filter 21 and A-D converter 22 of FIG. 1 are not depicted in FIG. 4. It will be understood that these elements are not included in circuit embodiments in which the speech signal to be analyzed has been previously filtered and converted to a digital signal. Thus in FIG. 4 the signal applied to signal input terminal 71 is comprised of digital words representing a speech signal sampled at 10 kHz. During state 0, 99 of these incoming words arrive at data latch 72 being loaded by the DTA RDY signal which is applied to terminal 73. The DTA RDY signal illustrated in FIG. 3 is a 10 kHz clock pulse which is derived from a $\overline{\text{DTA RDY}}$ signal supplied to the speech analyzer from the system A-D converter circuit (or other source of digital speech samples) with each clock pulse coincident with an output word of the A-D converter. Inversion of the applied $\overline{\text{DTA RDY}}$ is provided by the control logic gating circuitry of FIG. 9. During state 0, the RECIR DTA SEL control signal which is applied to terminal 74 is in the low state, thereby causing selector circuit 76 to connect the input of shift register 77 to the output of data latch 72. As shown in FIG. 3, the shift register clock signal, SR CLK, and hence the $\overline{\text{SR CLK}}$ signal, developed by the control gating circuit depicted in FIG. 9 is initiated slightly after the first $\overline{\text{DTA RDY}}$ pulse. This delay permits the data words to settle in latch 72 before they are transferred to shift register 77. Each of the 99 $\overline{\text{SR CLK}}$ pulses generated during state 0 and applied to terminal 81 transfers a data word from latch 72 to shift register 77. Since the $\overline{\text{SR CLK}}$ signal is also connected to shift registers 78 and 79, the digital words stored in each of these registers are shifted by one location with each updating word. Thus it can be seen that during state 0 speech samples are applied to terminal 71 and latch 72 and then coupled to shift register 77 as they become available from the system A-D converter or other source of digitally encoded sampled speech signal. Thus, at the conclusion of state 0, shift registers 77, 78, and 79 will hold 300 data words representative of a 30 millisecond speech interval. At this time, shift registers 78 and 79 will respectively contain the speech signals stored in shift registers 77 and 78 during the previous analysis interval. It will be ascertained, upon understanding the circuit operation during state 2, that the first speech sample of the updating interval was transferred to shift register 77 during state 2. Thus, in combination with the 99 additional incoming samples of state 0, the full 10 millisecond update is accomplished at the end of state 0. The transfer of this stray data word during state 2 facilitates real-time operation, since, with continuous speech sampling at 10 kHz, the stray data word overlaps the update cycle. Of course, this data word could, in all probability, by discarded without impairing circuit performance. Loading of the stray data word during state 2, however, is accomplished without appreciably increasing circuit complexity and provides a circuit implementation which exactly complies with Equation (2).

As noted in the discussion of the embodiment of FIG. 1, in the practice of our invention, the energy level determination of the updating speech interval is performed as the 100 updating data words are transferred to shift register 77 in the circuit of FIG. 4. The energy determination is performed by energy and clipping arithmetic unit 82. Energy and clipping level arithmetic unit 82 is further utilized during state 2 to determine the appropriate clipping level for the speech interval being processed. Thus, it can be recognized that arithmetic unit 82 illustrates one multiplexing technique which can be utilized in the practice of our invention. That is, arithmetic unit 82 utilizes common circuitry to perform circuit operations performed by clipping level control 36 and energy detector 28 of the embodiment depicted in FIG. 1.

As can be seen in FIG. 3, during state 0 the ADD SELECT control signal to selector 84 of arithmetic unit 82 is in the low state. This control condition causes each incoming updating data word from data latch 72 to be coupled through selector 84 to adder circuit 86. Each incoming data word is added to the value held in accumulator latch 87. It can further be seen in FIG. 3 that an $\overline{\text{ACCUM LD}}$ signal is generated by arithmetic gating circuit 89 of FIG. 4 at the end of each $\overline{\text{DATA RDY}}$ pulse. This control signal strobes the sum held in adder 86 into accumulator latch 87. Thus, accumulator latch 87 holds the sum of the past data samples at the end of each DTA RDY pulse. Since the energy is computed in accordance with Equation (1) and is a function of the magnitude of the speech samples, the data word sign bit is not connected to adder 86. It is assumed in this example that the data words are in sign-magnitude form. In addition to the $\overline{\text{ACCUM LD}}$ signals generated in state zero, a single $\overline{\text{ACCUM LD}}$ signal is generated by the final clock pulse of state 2 to thereby load the previously referred to stray data word. Thus it can be seen that at the conclusion of state 0 accumulator latch 87 holds a digital word representative of the energy of the 10 millisecond speech update interval.

At the beginning of state 1, the ENERGY LD control signal which is applied to terminal 91 and is generated by the control gating circuit of FIG. 9, strobes the energy representative digital word into energy latch 85. The energy level of each 10 millisecond speech interval is thus available at energy output terminal 38 for use within the system employing the speech analyzer of this invention.

During state 1, the maximum peak occuring during the first and last 100 data word interval of the 300 word analysis is determined. As can be seen in FIG. 4, each of the 100 updating data words is coupled to peak comparator 93 and maximum peak latch 94. Further, each of the data words transferred from shift register 78 to shift register 79 is coupled to peak comparator 96 and maximum peak latch 97. Comparators 93 and 96 compare the value of each digital word coupled to their input terminals with the value of the digital words stored in latch circuits 94 and 97, respectively. If the incoming data word is greater than the digital word in the latch circuit, the comparator generates a logical true output signal, with the output signal of comparator 93 connected to NAND gate 98 and the output signal of comparator 96 connected to NAND gate 99. The second input terminals of gates 98 and 99 are commonly connected to terminal 102, which receives the PEAK STROBE control signal. As shown in FIG. 3, a peak strobe pulse is generated by the control gating circuit of FIG. 9 coincidental with each SR clock pulse. Thus whenever the incoming data word is greater than the data word stored in latch 94, both a PEAK STROBE signal and comparator 93 logical true signal are applied to the input terminals of gate 98. In response to these input signals, gate 98 strobes peak latch 94 to load the incoming data word into the latch circuit. Peak comparator 96, max peak latch 97 and gate 99, operate in an identical manner to strobe a data word transferred between shift registers 78 and 79 into peak latch 97 whenever the transferred data word is larger than the word stored in latch 97. Thus, each data word entering shift register 77 and shift register 79 is compared with the largest preceding data word and at the end of state 0, peak latch 94 will contain the value of the largest data word in the 10 millisecond update interval and peak latch 97 will contain the largest data word of the final 10 milliseconds of the 30 millisecond processing interval (i.e., the 10 milliseconds of speech interval represented by the data samples contained in shift register 79). Peak latches 94 and 97 are cleared by the $\overline{\text{PEAK CLR}}$ signal which is, as shown in FIG. 3, coupled to terminal 101 during state 1. As seen in FIG.

4, the maximum peak values contained in peak latches 94 and 97 are coupled to comparator 103 and selector 104. Comparator 103 compares the value of the peak data word stored in maximum peak latch 94 with the value of the peak data word stored in maximum peak latch 97. The output of the comparator controls selector 104 such that the smaller of the peak signals, i.e., the lesser of the two peak signals of the first and third 10 millisecond speech intervals, is coupled to minimum peak shift register 106 of energy and clipping level arithmetic unit 82.

Figures 5, 7:
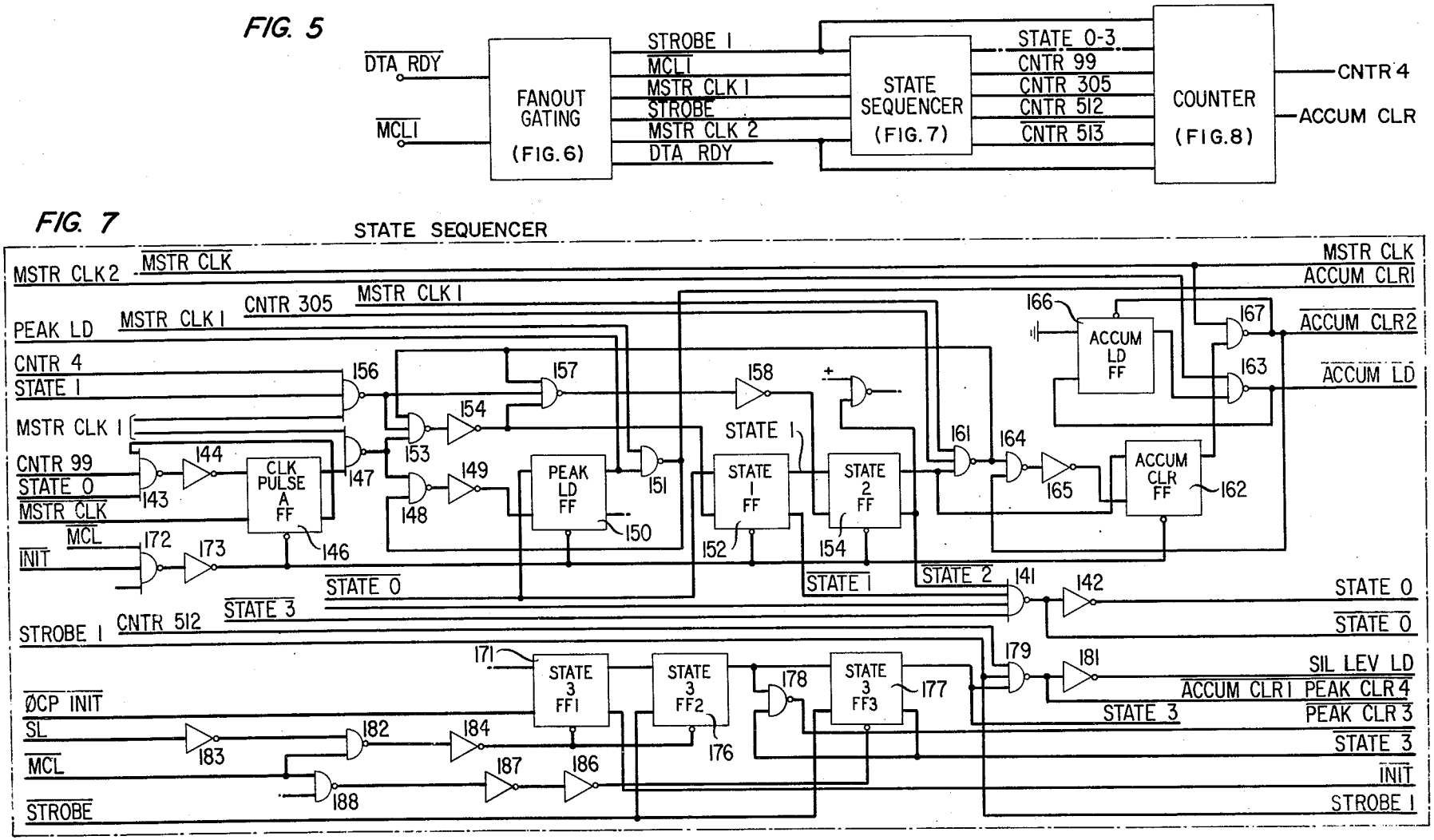
FIG. 5 depicts the interconnection of a sequencer circuit, counter circuit and fan-out gating circuit which are suitable for generating the sequencing signals for the clipping processor of FIG. 4.
FIG. 7 is a schematic drawing of the sequencer embodiment of FIG. 5.

As shown in FIG. 3, state 0 ends after 99 $\overline{\text{DTA RDY}}$ pulses and state 1 begins. As is further shown by the timing diagram of FIG. 3, the master clock signal (MSTR CLK) is gated after the 99th DTA RDY pulse, with the state sequencer circuit (FIG. 7) switching the clipping processor from state 0 to state 1 during the trailing edge transition of the first MSTR CLK pulse. During state 1, the "percent of peak signals" is determined by energy and clipping level arithmetic unit 82 in order to set the clipping processor clipping level. As shown in FIG. 3, the ADD SELECT signal enters its high state as state 1 is initiated. This causes selector 84 to connect adder 86 to the output of minimum peak shift register 106. Adder 86 and accumulator latch 97 are prepared for the percent of peak signal calculation by the second master clock pulse of state 1, which, as shown in FIG. 7, causes the generation of the $\overline{\text{ACCUM CLR}}$ signal applied to terminal 88. The $\overline{\text{ACCUM CLR}}$ signal clears accumulator latch 87 of the digital word which remains in latch 87 as the result of the energy calculation during state 0. Further, coincident with the second MSTR CLK signal, the control gating logic circuit of FIG. 9 generates the percent CLK control signal of FIG. 3. The first percent CLK pulse loads the lesser peak value from selector 104 into minimum peak shift register 106 and the percent clipping level multiplier contained in latch 107 into clipping level shift register 108. As previously described, the percent clipping level is a predetermined number which is stored in latch 107 and may be under the control of the speech analyzer operator, e.g., the operator may strobe a desired value into latch 107 by any conventional means, or this parameter may be a fixed value stored in any conventional way, e.g., a set of switches.

The shift and load conditions of shift registers 106 and 108 are determined by the $\overline{\text{PEAK LD}}$ signal and the % CLK pulse signal. Data is loaded when the $\overline{\text{PEAK LD}}$ is low and shifted when it is high.

If the shifted bit of shift register 108 is a logical 1, accumulator latch 87 is strobed via NAND gate 115 and inverter 116 of arithmetic gating circuit 89 and the corresponding bit in the minimum peak signal is added to value held in accumulator latch 87. Thus, where a 4-bit percent clipping level multipler is contained in latch 107, the value coupled to accumulator latch 87 with each add operation is any combination of ½, ¼, or ⅛ times the minimum peak signal contained in shift register 106. Accordingly, it can be seen that the clipping level of the embodiment of FIG. 4 can be established between 0.125 times the minimum peak level and 0.875 times the minimum peak level in multiplicative increments of 0.125. This range has proven satisfactory in the practice of this invention and the elimination of conventional multiplication circuits to determine the percent clipping level provides the operational speed necessary to perform continuous real-time analysis. If a wider range of clipping levels is desired, larger digital words and a corresponding number of % CLK pulses may be employed.

At the conclusion of the calculation of the percent of peak level, (i.e., after 6 of the % CLK pulses) the clipping processor enters state 2. During state 2, the clipping operation is performed and a data word representing each clipped speech sample is transferred to the memory unit of the autocorrelation processor. In accordance with the embodiment of this invention depicted in FIG. 4, the clipped data is determined by comparing each signal sample or data word with both the silence level and the clipping level. As shown in the timing diagram of FIG. 3, state 2 commences with the return of the STATE 1 control signal to the low state and the transition of the STATE 2 control signal to the high state. The transition of the STATE 2 signal to the high state causes the ADD SEL signal (generated by the control gating logic circuit of FIG. 9) to enter the low state which activates selector 76 to complete the recirculation path 118 around shift registers 77, 78, and 79. Data words are shifted through the shift registers by the $\overline{\text{SR CLK}}$ signal which is also generated by the control gating logic of FIG. 9. During state 2, 300 $\overline{\text{SR CLK}}$ pulses are generated to couple each data word to clipper 117 while simultaneously recirculating the data through shift registers 77, 78 and 79. Each shifted data word is coupled to one input terminal of clipping level comparator 121 and one input terminal of silence level comparator 122. The sign bit of the shifted word is coupled to the input terminal of inverter 123 and also to one input terminal of three input NAND gate 124.

Clipping level comparator 121 is a conventional comparator circuit which compares the shifted data word with the clipping level which was determined in state 1 and generates an output signal indicative of whether the magnitude of the shifted data word is greater than the clipping level. In the embodiment of FIG. 4, the output signal Y of clipping level comparator 121 is logically true whenever the magnitude of the shifted data is greater than the clipping level stored in accumulator latch 87.

Silence level comparator 122 is a conventional comparator circuit which compares each shifted data word with the silence threshold contained in silence latch 127. In the embodiment of FIG. 4, if the magnitude of the shifted data word exceeds the magnitude of the silence threshold, output signal X of comparator 122 will be logically true. Since the outputs of comparators 121 and 122 are each connected to one input terminal of three input NAND gates 124 and 126, it can be observed that unless both comparator outputs X and Y are logically true, the output of both gates 124 and 126 will be logically true, thus unless the shifted data word is greater in magnitude than both the silence level and the clipping threshold outputs $\overline{I_0}$ and $\overline{I_1}$ are logically true. However, if the magnitude of the shifted digital word exceeds both threshold values, it can be observed that two inputs of both NAND gates 124 and 126 are logically true. Since the sign bit of the shifted digital word is connected directly to the third input of NAND gate 124, and is connected to the third input of NAND gate 126 through inverter 123, it can be observed that when both X and Y are true, either NAND gate 124 or NAND gate 126 will generate a logical 0. More specifically, it can be seen that when the incoming data word is positive and of a magnitude exceeding the silence and clipping level, all inputs to NAND gate 124 will be true and gate 124 will generate an output signal, $\overline{I_0}$ which corresponds to a logical 0. In a similar manner, when the shifted data word is negative and of a magnitude which exceeds both thresholds, all inputs to gate 126 will be true and gate 126 will generate a signal $\overline{I_1}$ which corresponds to a logical 0.

Referring to the clipped speech signal depicted in FIG. 2B, it can be seen that if the signals $\overline{I_0}$ and $\overline{I_1}$ are considered to be a 2 bit digital word, clipper 117 produces the digital signal 00 whenever the shifted speech sample fails to exceed the clipping level or the threshold level (noted as 0 in FIG. 2B); a digital signal 10 whenever the speech sample is positive and exceeds both thresholds (denoted as +1 in FIG. 2B); and a digital signal 01 whenever the speech sample is negative and exceeds both threshold values (denoted as −1 in FIG. 2B). As each data word or speech sample is shifted and processed by clipper 117, the resulting clipped data word is coupled to the memory unit of the autocorrelation processor.

As shown in the timing diagram of FIG. 3 after the 300 data words have been processed by clipper 117, that is, after 300 SR CLK pulses, the RECIR DTA SEL signal returns to the low state to thereby activate selector 76 to connect the input of shift register 77 to the output of data latch 72. As further shown in FIG. 3, the previously referred to stray data bit arrives at input terminal 71 with the concomitant DTA RDY signal arriving at terminal 73. A single PEAK STROBE signal generated by the control gating logic circuit of FIG. 9, loads the stray data word into data latch 72. This data word is loaded from data latch 72 into shift register 77 by the 301st SR CLOCK pulse and the clipping processor is ready for the remaining 99 data words which will be loaded during state 0 of the next processing interval. After the stray data word has been loaded into shift register 77, the sequencer circuit of FIG. 7 returns the clipping processor state 0 and the above described clipping process is repeated for the next speech processing interval.

As previously discussed, the silence level threshold may be a predetermined value or may be adaptively determined during a training interval in which the speech analyzer is generally subjected to the environmental background noise. The timing diagram of FIG. 3 depicts one technique of adaptively determining the silence threshold during a fourth operational state hereinafter referred to as state 3. In the embodiment of FIG. 4, peak comparator 93, operating in conjunction with maximum peak latch 94, is utilized to determine the peak signal occurring in an interval of 512 data words. It should be realized that any convenient number of background samples may be utilized to establish the silence threshold. The 51.2 milliseconds training interval was chosen for one realization of the embodiment of FIG. 4 primarily to accomodate utilization of this invention in conjunction with conventional telephony where there is inherently a short time interval between the time a telephone connection is completed and the time speech communication begins. As shall be discussed with respect to the sequencer circuit of FIG. 7, the embodiment of FIG. 4 is arranged such that state 3 can be initiated not only at the beginning of a particular communication but also can be initiated at any time the analyzer operator so desires. During state 3, arriving samples are loaded in shift register 77 via data latch 72 by the SR CLK pulses in the same manner as speech samples are loaded during state 0. Peak comparator 93 and maximum peak latch 94 also operate in the same fashion as previously described in the discussion of state 0, that is, comparator 93 compares each incoming data word with the value contained in latch 94 and the incoming data word is strobed into latch 94 by NAND gate 98 which operates under the control of the PEAK STROBE control signal and the comparator output signal. Accordingly, latch 94 continually contains the magnitude of the maximum data sample of those data samples which have been loaded into shift register 77. The sequencer circuit of FIG. 7 generates a silence level load (SIL LEV LD) Control signal coincident with the 513th peak stroke signal of state 3, to strobe the value contained in latch 94 into silence latch 127. State 3 is then terminated by the sequencer circuit and the clipping processor automatically enters state 0 to begin processing incoming speech samples of the next analysis interval.

CLIPPING PROCESSOR SEQUENCER OPERATION

Figure 6:
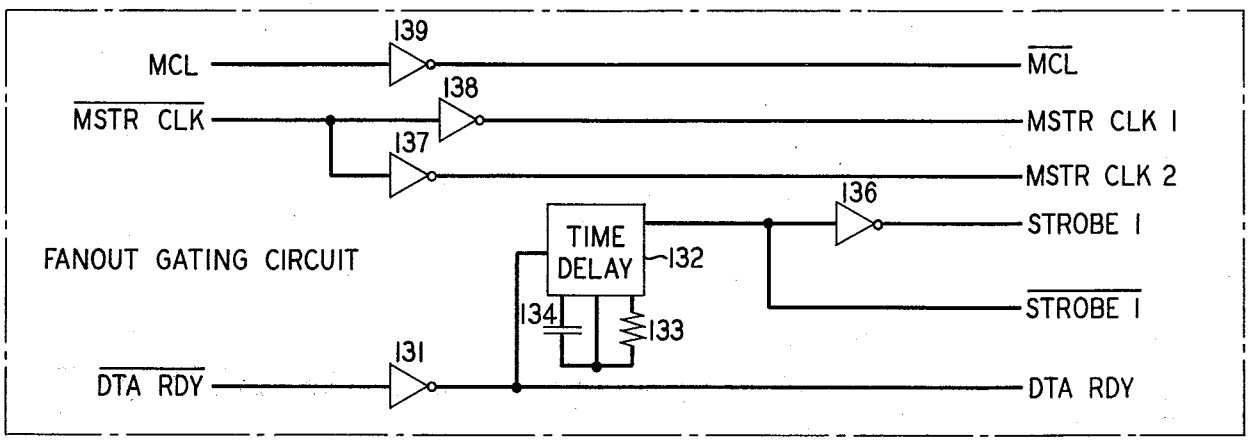
FIG. 6 illustrates in detail, the fan-out circuit embodiment of FIG. 5.
Figure 8:
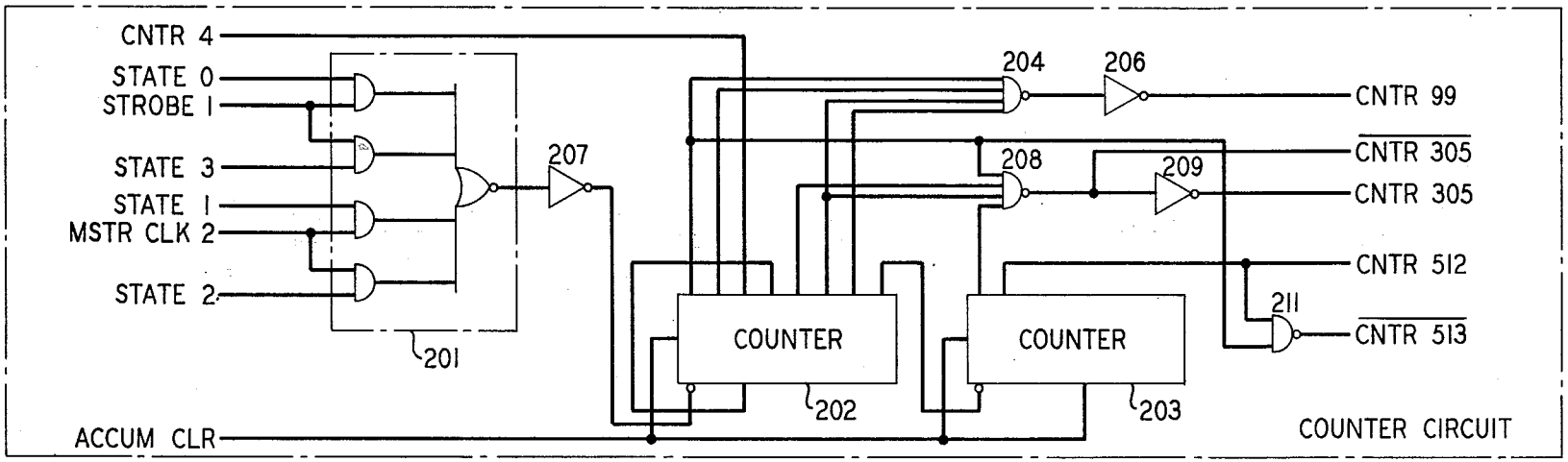
FIG. 8 depicts the circuit details of the counter circuit embodiment of FIG. 5.

FIGS. 5–8 depict one embodiment of circuits suitable for generating signals for controlling the operation of the clipping processor embodiment depicted in FIG. 4, with FIG. 5 depicting the interconnection of the state sequencer circuit of FIG. 7 with the fan-out gating circuit and counter circuit of FIGS. 6 and 8 respectively.

The fan-out gating circuit of FIG. 6 provides the necessary fan-out to drive the circuitry of the clipping processor of FIG. 4 and also derives a time-delayed DTA RDY signal which is supplied to the control gating logic circuit of FIG. 9 to generate the SR CLOCK and PEAK STROBE signals and is utilized to drive the counter circuit of FIG. 8. As shown in FIG. 6, the $\overline{\text{DTA RDY}}$ signal from the system data source (A - D converter, or other source of digitally encoded speech samples) passes through inverting driver circuit 131 to supply the DTA RDY signal utilized in loading incoming data words into data latch 72 of FIG. 4. In addition, the $\overline{\text{DTA RDY}}$ signal is coupled to conventional time delay circuit 132 (e.g., the commercially available device identified by a number of digital circuit manufactures as device model 74221). As is known in the art, resistor 133 and capacitor 134 which are connected to time delay circuit 132 establish the length of the time delay. As is shown in FIG. 6, the output of time delay circuit 132 is identified as the $\overline{\text{STROBE 1}}$ signal and the output of time delay circuit 132 is inverted by inverter circuit 136 to supply a signal identified as the STROBE 1 signal. As shall be discussed with respect to the sequencer circuit of FIG. 7, and the clock circuit of FIG. 8, the STROBE 1 and $\overline{\text{STROBE 1}}$ signals, are used to generate the delayed SR CLOCK and PEAK STROBE signals and to increment the counter.

Figure 18:
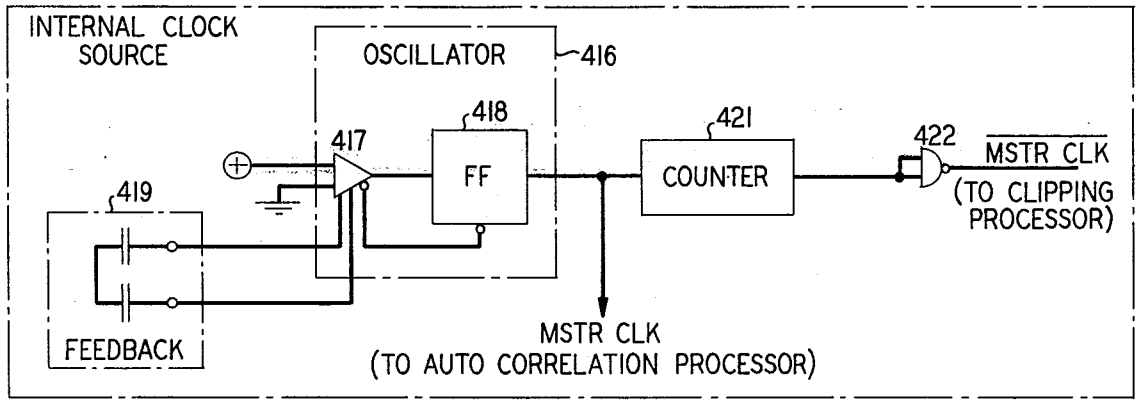
FIG. 18 depicts an internal clock source suitable for controlling the operation of the clipping processor and autocorrelation processor of the illustrative embodiment of this invention.

The $\overline{\text{MSTR CLK}}$ control signal supplied by the internal clock circuit depicted in FIG. 18 is fanned-out by inverting drivers 137 and 138 to form the MSTR CLK 1 and MSTR CLK 2 control signals. As shall be discussed in more detail hereinafter, the MSTR CLK 1 and MSTR CLK 2 signals are used in the control gating circuit of FIG. 9 to supply particular ones of the control signals depicted in FIG. 3 are used to increment the counter of FIG. 8, and are used to clock the state sequencer circuit of FIG. 7.

As discussed with respect to the clipping processor embodiment of FIG. 4, the function of the state sequencer circuit of FIG. 7 is to provide operational control of the clipping processor. The switching of the clipping processor from one operational state to another e.g., state 0 to state 1, is based on the accumulated count signals supplied to the sequencer circuit by the counter circuit of FIG. 8. Each state enables control signals based on data strobes and/or the clock pulses generated by the internal clock circuit of FIG. 18 to load the required registers in accordance with the timing diagram of FIG. 3.

An externally generated master clear (MCL) signal, which may be activated by the analyzer operator at the beginning of the analysis or at any desired time, assures that the state sequencer will begin with the proper generation of a STATE 0 control signal. The MCL signal is inverted by inverter 139 of the circuit of FIG. 6 to provide a $\overline{\text{MCL}}$ control signal. The $\overline{\text{MCL}}$ signal resets each flip-flop circuit depicted in FIG. 7. Resetting all flip-flops sets state 0 which is true when all other states are false. Thus state 0 is effectively a default condition with the sequencer circuit generating a STATE 0 control signal whenever a control signal is not generated to place the clipping processor in state 1, 2 or 3. As depicted in FIG. 7, the state 0 signal is generated by NAND gate 141 which is responsive to the "state not" conditions. The output of NAND gate 141 supplies the $\overline{\text{STATE 0}}$ signal and the output of inverter 142, the input terminal of which is connected to the output terminal of NAND gate 141, supplies the STATE 0 signal.

NAND gate 143, inverter 144, $\overline{\text{MSTR CLK}}$ pulse, and CLK PULSE AFF 146 provide the pulse synchronization required in going from the asynchronous STROBE pulses to the internally generated master clock ($\overline{\text{MSTR CLK}}$) signals. The output of NAND gate 143, which is responsive to the CNTR 99 counter signal and the STATE 0 control signal, is inverted by inverter 144 and connected to flip-flop 146. The $\overline{\text{MSTR CLK}}$ signal is connected to the clock input of flip-flop 146. The trailing edge of the first MSTR CLK pulse sets up flip-flop 146, thus ensuring that the first MSTR CLK pulse of state 0 (identified as CLK A in FIG. 3) will be generated by the next pulse from internal clock 66. This synchronization eliminates the possibility of pulse splitting in generating the first master clock pulse of state 0. The output of flip-flop 146 is fed back to a third input of NAND gate 143 to reset flip-flop 146 at the end of CLK A, thereby preventing further clock pulse outputs from flip-flop 146.

As shown in FIG. 3, the trailing edge transition of the CLK A pulse causes the sequencer circuit to switch the clipping processor from state 0 to state 1 and also causes the generation of the previously discussed PEAK LD control signal. Referring to FIG. 7, it can be seen that the PEAK LD signal is supplied by NAND gate 148, inverter 149 and peak load flip-flop 150. The output of NAND gate 148 which is enabled by the ACCUM CLR 1 signal (generated by flip-flop 150 in conjunction with NAND gate 151), is coupled to the input terminal of inverter 149. The output of inverter 149 supplies the clock signal for peak load flip-flop 150. The $\overline{\text{STATE 0}}$ control signal is connected to the input of peak load flip-flop 150 and noninverted output of flip-flop 150 is utilized as the PEAK LD control signal of FIG. 3.

The PEAK LD control signal enables NAND gate 151 and the next MSTR CLK 1 signal is utilized as the ACCUM CLR 1 signal. As discussed with respect to the clipping processor embodiment of FIG. 4, the ACCUM CLR 1 signal resets accumulator latch 87 and max peak latches 94 and 97. The trailing edge of this MSTR CLK pulse resets peak load flip-flop 150 thereby disabling NAND gate 151.

The generation of the state 1 control signal is also initiated by the trailing edge transition of the MSTR CLK signal CLK A pulse by connecting the input of flip-flop 152 to the $\overline{\text{STATE 0}}$ signal and clocking the flip-flop with MSTR CLK 1 pulses which are coupled to the clock input of flip-flop 152 via NAND gates 147 and 153 and inverter circuit 154. After generation of the ACCUM CLR signal, the next four master clock pulses of state 1 are used in the percent clipping level computation discussed with respect to the clipping processor embodiment of FIG. 4. With the occurrence of four master clock signals, the CNTR 4 signal is generated by the clock circuit of FIG. 8. The CNTR 4 signal, the STATe 1 signal, and the MSTR CLK 1 signal are connected to the input terminals of NAND gate 156. The next MSTR CLK pulse clears state 1 signal and sets state 2 through NAND gate 157. The sequencer circuit maintains the clipping processor in state 2 during the generation of the next 300 clock pulses each of which transfers a speech sample from shift register 79 of FIG. 4 to clipper circuit 117. The conclusion of this data transfer is indicated by the generation of a CNTR 305 signal generated by the counter circuit of FIG. 8. The CNTR 305 signal, the STATE 2 signal, and the MSTR CLK 1 signal are connected to the input terminals of three input NAND gate 161. The next MSTR CLK 1 pulse enables flip-flop 162 via NAND gate 164 and inverter 165. Enabling flip-flop 162 generates the $\overline{\text{ACCUM CLR 2}}$ signal coincident with next MSTR CLK pulse which clears accumulator latch 87 of FIG. 4. This MSTR CLK 1 pulse also resets state 2 flip-flop 154 through the operation of NAND gate 161 and 157 in conjunction with inverter 158. The $\overline{\text{ACCUM LD}}$ signal is generated by flip-flop 166 which is preset by the $\overline{\text{ACCUM CLR 2}}$ signal thereby enabling NAND gate 163. The next MSTR CLK 2 pulse enables the $\overline{\text{ACCUM LD}}$ signal while simultaneously clocking flip-flop 166 to produce a single $\overline{\text{ACCUM LD}}$ pulse to load the stray data bit into accumulator 87. As previously discussed, state 0 is then enabled by default since the state 1, state 2 and state 3 signals are in the logical low condition the sequencer circuit begins to cycle through state 0 for the next analysis interval.

A state 3 sequence can be initiated at any desired time through the use of an externally generated $\overline{\text{OCP INIT}}$ pulse. This pulse sets flip-flop 171 which generates an $\overline{\text{INIT}}$ signal which is coupled to one input terminal of NAND gate 172. The output of NAND gate 172 is inverted by inverter 173 and connected to the reset terminals of flip-flops 146, 150, 152, 159 and 162 to reset state 0, 1, or 2 if they happen to be enabled when state 3 is initiated.

The first $\overline{\text{STROBE}}$ pulse after flip-flop 171 is set, sets flip-flop 176. Setting flip-flop 176 supplies the $\overline{\text{PEAK CLR 3}}$ signal through NAND gate 178 to clear max peak latches 94 and 97 of FIG. 4, and to clear the counter circuit of FIG. 8. The next $\overline{\text{STROBE}}$ pulse sets flip-flop 177 generating the STATE 3 control signal and resetting the $\overline{\text{PEAK CLR 3}}$ signal through the operation of NAND gate 178. The next 512 $\overline{\text{STROBE}}$ pulses transfer data words through peak comparator 93 and max peak latch 94 of FIG. 4 to determine the silence threshold value. After 512 $\overline{\text{STROBE}}$ pulses, the clock circuit of FIG. 8 generates the CNTR 512 signal. The CNTR 512 signal, the STROBE 1 signal and the STATE 3 signal are connected to the input terminals of three input NAND gate 179. With NAND gate 179 enabled by the CNTR 512 signal and the STATE 3 signal, the next STROBE 1 pulse generates the SIL LEV LD signal via inverter 181 to load silence level latch 127 of FIG. 4. This STROBE 1 pulse also clears max peak latch 94. After the STROBE 1 pulse the counter circuit of FIG. 8 generates the CNTR 513 signal which clears flip-flops 171 and 176 by the operation of NAND gates 182 and inverters 186 and 187 to reset the sequencer circuit to a state 0 condition. Once the sequencer is placed in the state 0 condition, the sequencer circuit cycles through states 0 through 2 to process the next analysis interval of the incoming speech signal.

It can be seen from the above discussion of the sequencer circuit that the counter circuit of FIG. 8 provides count indications to the sequencer which signal the completion of particular data transfers. During state 0 the combined AND-NOR gating enclosed within dashed outline 201 combines the STATE 0 control signal and the STROBE 1 control signal depicted in FIG. 3 to increment counters 202 and 203. The logic circuit contained within dashed outline 201 may be realized by separate logic elements or is commercially available from a number of manufacturers under the designation of circuit module 74S64. Upon the completion of the 99 word update which occurs during state 0, counter 202 reaches the count 99 and through the operation of NAND gate 204 generates the CNTR 99 control signal. NAND gate 204 is connected to counter 202 in a manner well known in the art, such that all inputs to NAND gate 204 will be logically true after 99 counter pulses. As can be seen in FIG. 8, the output of NAND gate 204 is inverted by inverter 206 to provide the CNTR 99 control signal. As previously discussed, the state sequencer circuit of FIG. 7 utilizes the CNTR 99 signal to increment the state sequencer to state 1. The ACCUM CLR signal generated coincident with the second MSTR CLK pulse of state 1 resets counters 202 and 203. The conclusion of the four % CLK pulses utilized in state 1 to compute the percent of clipping level is indicated by a count of four MSTR CLK 2 pulses which are coupled to counters 202 and 203 through logic circuit 201 and inverter 207. Since the counters are not reset after counting the four MSTR CLK 2 pulses which occurred during the percent clipping level calculation, an accumulated count of 305 indicates the completion of a 300 word data transfer to the autocorrelation processor. The CNTR 305 signal is supplied by NAND gate 208 and inverter 209 with the output of NAND gate 208 providing the $\overline{\text{CNTR 305}}$ signal. The previously described ACCUM CLR signal supplied by the sequencer circuit of FIG. 7 following the transfer of 300 data words through clipper 117 of FIG. 4 resets counters 202 and 203. Thus the counter circuit is ready to accept the strobe pulses generated during state 0 of the next speech analysis interval.

When state 3 is initiated, a count of 513 is used to indicate the transfer of 512 data words for the determination of the silence level threshold. State 3 is gated with STROBE 1 pulses through logic circuit 201 and inverter 207 to increment counters 202 and 203. The ACCUM CLR signal generated at the end of state 3 resets the counter and returns the system back to its normal cyclic sequence beginning with state 0. The $\overline{\text{CNTR 513}}$ control signal utilized by the sequencer circuit of FIG. 7 to reset state 3 flip-flops 171 and 176 is supplied by NAND gate 211 which is responsive to the binary outputs of counter 202 and 203 which indicate a count of 512 and a count of 1. In examining the counter circuit of FIG. 8 it will be realized that the two separate counters (202 and 203) are necessary only when utilizing a counter 202 which is not capable of detecting a count of 512.

As shown in FIG. 9, the ADD SELECT signal utilized in state 1 to control selector 84 of FIG. 4 and the ENERGY LD signal utilized in state 1 to load energy latch 89 are each supplied by inverter 216 which inverts the STATE 1 signal supplied by the sequencer circuit of FIG. 7.

The REC DTA SEL signal, used to control selector 76 of FIG. 4, is generated by NAND gate 217 and inverter 218. The STATE 2 control signal and the $\overline{\text{CNTR 305}}$ signal are supplied to the input terminals of NAND gate 217, thus producing a RECIR DTA SEL signal which is logically in the high state during that portion of state 2 subsequent to 305 master clock pulses. The TRNS DTA control signal is derived at the output of NAND gate 217. The TRNS DTA signal is supplied to the autocorrelation processor to indicate that the clipping processor embodiment depicted in FIG. 4 is beginning to transfer a block of 300 data words which represent the clipped speech samples of a particular analysis interval. That is, the TRNS DTA signal indicates to the autocorrelation processor that new data is about to be transferred from the clipping processor.

The PEAK CLR control signal is generated by NAND gate 219 when either MCL, $\overline{\text{PEAK CLR 4}}$, $\overline{\text{PEAK CLR 1}}$, or $\overline{\text{PEAK CLR 3}}$ signals are generated. The $\overline{\text{PEAK CLR 1}}$ signal, the $\overline{\text{PEAK CLR 3}}$ signal, and the $\overline{\text{PEAK CLR 4}}$ signals are combined by NAND gate 219 and inverted by inverter 220 to form the PEAK CLR signal. Similarly, the $\overline{\text{ACCUM CLR}}$ signal is generated by NAND gate 221 and inverter 222 when either an $\overline{\text{ACCUM CLR 1}}$ signal, $\overline{\text{MCL}}$ signal, a $\overline{\text{ACCUM CLR 2}}$ signal, or a $\overline{\text{ACCUM CLR 3}}$ control signal is generated. As previously discussed, the ACCUM CLR signal clears accumulator latch 87 of FIG. 4 and resets the counter of FIG. 8.

The $\overline{\text{ACCUM LD}}$ control signal is generated for each STROBE 1 signal during state 0 by gating STATE 0 and STROBE 1 at NAND gate 223 or is generated when the $\overline{\text{ACCUM LD 2}}$ signal is generated. As previously described, the $\overline{\text{ACCUM LD 2}}$ signal is the accumulator load signal which occurs at the start of state 0 to load the stray data word. The % CLK signal is generated by NAND gate 226, and the MSTR CLK control signals are connected to the input terminals of NAND gate 226 to supply a % CLK pulse coincident with each MSTR CLK pulse generated during state 1.

The DTA STROBE signal which is coupled to the autocorrelation processor to indicate the transfer of each data word processed by clipper 117 of FIG. 4 is generated by NAND gate 228 and inverter circuit 229. The STATE 2 control signal and the MSTR CLK signal are combined by NAND gate 228 and inverted by inverter 229 to produce a DTA STROBE pulse coincident with MSTR CLK generated during state 2.

The $\overline{\text{SR CLK}}$ pulses utilized during state 2 to shift data through shift registers 77, 78 and 79 of FIG. 4 are also generated by NAND gate 228 operating in conjunction with NAND gate 231 and inverter 232. As previously discussed, $\overline{\text{SR CLK}}$ signals are also generated during state 0 and state 3 to shift data words through shift registers 77, 78, and 79. These $\overline{\text{SR CLK}}$ pulses are generated by NAND gates 233 and 234 which operate in conjunction with NAND gate 231 and inverter circuit 232. The output of NANd gate 233 and the STROBE 1 control signal are connected to the input terminals of NAND gate 234. Thus, it can be seen that each STROBE 1 signal pulse generates a $\overline{\text{SR CLK}}$ pulse.

The PEAK STROBE signal utilized to strobe max peak latches 94 and 99 of the clipping processor embodiment depicted in FIG. 4 are provided by the cascade connected inverters 236 and 237. It will be recognized by those skilled in the art that cascade connected inverters 236 and 237 act as a driver circuit to provide fan-out of the strobe 1 signal in order to achieve the peak strobe function.

OPERATIONAL SEQUENCE OF THE AUTOCORRELATION PROCESSOR

Figure 10:
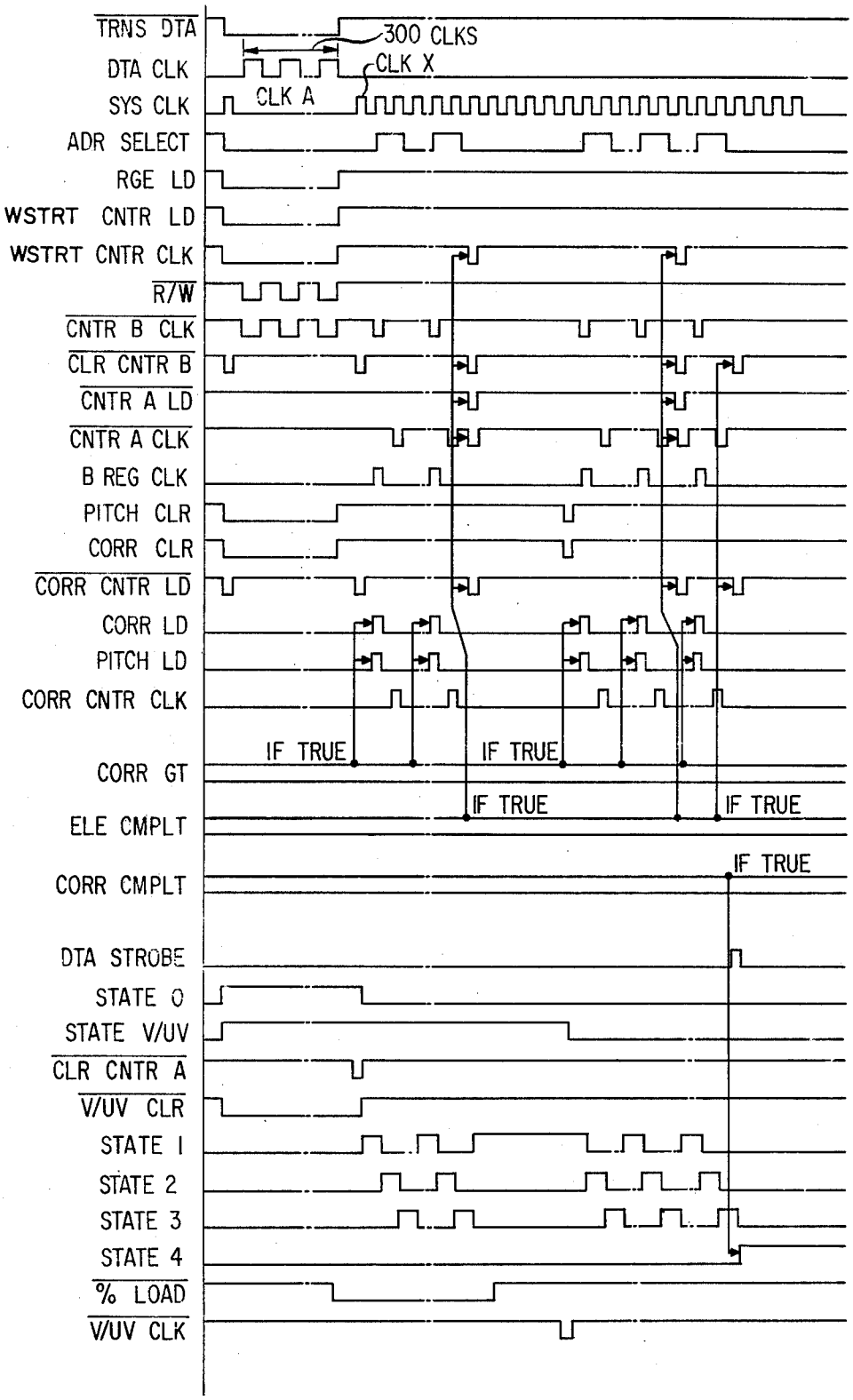
FIG. 10 depicts a timing and sequence diagram of the autocorrelation of processor of the illustrative embodiment of this invention.

The operating sequence of the autocorrelation processor of this illustrative embodiment includes five distinct operating states and an additional state in which the voice/unvoiced threshold is determined. During the first operational state, hereinafter denoted state 0, the autocorrelation processor is initialized and the 300 two bit data words supplied by the clipping processor are loaded into the autocorrelation processor memory. When the autocorrelation computation to calculate the autocorrelation functions of a particular 300 word speech interval begins, the $\overline{\text{TRNS DTA}}$ control signal, generated in gate 217, coupled to the autocorrelation processor from the clipping processor activates the sequencer circuit of FIG. 11 to place the autocorrelation processor in state 0. As shall be discussed with respect to the operation of the autocorrelation processor during state 4, the autocorrelation processor remains in state 4 after the conclusion of each autocorrelation calculation sequence. The $\overline{\text{TRNS DTA}}$ signal initializes the autocorrelation processor for the calculation of the autocorrelation function by resetting address selector 42 to thereby direct memory addressing from B counter 61, by clearing path latch 44 by means of the PITCH CLR signal of FIG. 10 and by clearing max peak latch 49 by means of the CORR CLR signal. The autocorrelation processor is further initialized by the SYS CLK pulse denoted as CLK A depicted in FIG. 10. The SYS CLK signal is derived from an internal clock source (e.g., clock 66 of FIG. 1) by the autocorrelation sequencer circuit of FIG. 11. As can be seen in FIG. 10, CLK A is generated at the start of $\overline{\text{TRNS DTA}}$ signal. CLK A further initializes the autocorrelation processor by clearing B counter 61 by means of the $\overline{\text{CLR CNTR B}}$ signal of FIG. 10 and by setting U/D counter 47 to a count corresponding to a value of zero by means of the $\overline{\text{CORR CNTR LD}}$ signal of FIG. 10. With the autocorrelation processor thus initialized, the data load sequence begins as DATA CLK pulses are received from the clipping processor each time a new two bit data word becomes available from clipper 117 of FIG. 4. The $\overline{\text{R/W}}$ (read-write signal of FIG. 10 provides the autocorrelation processor memory write control necessary to strobe incoming data words into successive storage locations.) During state 0 the $\overline{\text{CNTR B CLK}}$ control signal increments B counter 61 to access a new memory location prior to receiving the next incoming data word. As can be seen in FIG. 10, the $\overline{\text{R/W}}$ control signal and the $\overline{\text{CNTR B CLK}}$ signal correspond to an inverted DTA CLK signal.

As discussed with respect to the clipping processor of FIG. 4, 300 speech samples are processed during each analysis interval and the $\overline{\text{TRNS DTA}}$ signal which is coupled from the clipping processor to the autocorrelation processor goes high each time a new block of 300 data words is to be transferred to the autocorrelation processor. Thus after loading a block of 300 data words into the memory, the $\overline{\text{TRNS DTA}}$ control signal returns high. In response to the $\overline{\text{TRNS DTA}}$, the RGE LD signal of FIG. 10 is generated by the control logic circuit of FIG. 12 to load the address of the last incoming data word (which is contained in B counter 61) into range register 64. Although the address will be identical in each autocorrelation processor cycle as long as a fixed number of data words are processed, the use of a range register in which the range is loaded during each calculation sequence will permit a different data range to be utilized without affecting the autocorrelation logic circuitry. The clipping processor of FIG. 4 would, of course, be modified if a variable range or a range other than 300 data samples is employed. The $\overline{\text{TRNS DTA}}$ signal also loads the starting lag address counter 57 with the preset parameter which is contained in $M_i$ register 56 of FIG. 1. The loading of the starting lag address is effected by the WSTRT CNTR LD and WSTRT CNTR CLK signals of FIG. 10 which are generated by the control logic circuit of FIG. 12. A SYS CLK pulse denoted in FIG. 10 as CLK X in FIG. 10 is generated by the sequencer circuit of FIG. 12 during the final portion of the $\overline{\text{TRNS DTA}}$ signal. The CLK X signal clears B counter 63 by means of the $\overline{\text{CLR CNTR B}}$ control signal, resets the correlation counter by means of the $\overline{\text{CORR CNTR LD}}$ signal, clears A counter 63 by means of the $\overline{\text{CLR CNTR A}}$ signal to set the zero lag address, and finally resets the voiced/unvoiced threshold latch of FIG. 17 by means of the $\overline{\text{V/UV CLR}}$ signal. Additionally, the sequencer circuit of FIG. 11 switches the autocorrelation processor from state 0 to state 1 in response to the CLK X pulse. Thus it can be seen that during state 0 the autocorrelation processor is initialized and that a block of 300 data words representing a clipped speech samples of a particular 30 millisecond analysis interval are loaded into the autocorrelation processor memory. Additionally, since data words are loaded as they arrive from clipper 117 of the clipping processor embodiment of FIG. 4, it can be seen that the autocorrelation processor operates in state 0 during the same period of time that the clipping processor operates in state 2.

The autocorrelation function is computed in accordance with the Equation 2 during states 1, 2 and 3. Specifically, one of the data words (i.e., $x(n)$ in Equation 2) is coupled from the autocorrelation processor memory to the combinational logic circuit during state 1 and a second data word (i.e., $x(n+m)$ in Equation 2) is coupled from the autocorrelation processor memory to the combinational logic during state 2. The two data words are combined by the combinational logic to control the up/down or correlation counter. State 3 is utilized to determine whether the correlation calculation has been completed at a single lag element $m$ of Equation 2 or whether the complete autocorrelation calculation has been completed, i.e., whether the data words corresponding to the upper summation limit at the final lag element of Equation 2 have been coupled to the combinational logic.

When it is determined during state 3 that the autocorrelation computation is complete the sequencer circuit of FIG. 11 switches the autocorrelation processor into state 4. The STATE 4 control signal of FIG. 10 gates the result of the voiced/unvoiced threshold comparison to clear the pitch latch whenever the calculated peak autocorrelation value is less than the unvoiced threshold or to load the last pitch estimate from the pitch latch whenever the calculated autocorrelation value exceeds the unvoiced threshold.

In accordance with the illustrative embodiment of this invention, the voiced/unvoiced threshold is determined during state V/UV. As can be seen in FIG. 10, the autocorrelation processor is in state V/UV as the autocorrelation calculation cycle begins. During state V/UV the autocorrelation computation is performed in the usual manner, that is, the autocorrelation processor cycles through states 1, 2 and 3. The only difference between the function of the autocorrelation processor during state U/UV and during the normal calculation sequence is that during the U/UV sequence, A counter 63 of FIG. 1 is set to contain the address data for the zero lag element. Thus as the autocorrelation processor cycles through state 1 and state 2 while simultaneously in state V/UV, the autocorrelation function at zero lag is computed. This calculation sequence is temporarily interrupted at the completion of the zero lag computation, i.e., when it is determined during state 3 that the upper summation of the equation 2 has been reached. This interrupt allows the system to compute a percent of the zero lag value to be used as the V/UV threshold. As shall be discussed with respect to FIG. 17, the percent computation is performed by a shift and add procedure similar to that used in the clipping processor embodiment of FIG. 4 to compute the clipping level threshold. At the conclusion of the percent of zero lag calculation, the pitch latch and maximum correlation latch, e.g., latches 44 and 49 of FIG. 1 are cleared by the PITCH CLR and CORR CLR control signals which are generated by the sequencer circuit of FIG. 11 during the final pulse of the percent CLK control signal. At this point, the V/UV state is reset and the internal clock is redirected to generate the SYS CLK signal. The autocorrelation processor then continues to cycle through states 1, 2 and 3 as described above until the autocorrelation function is calculated at each lag element.

FIG. 11 illustrates a circuit arrangement suitable for generating the control signals depicted in FIG. 10. As can be seen in FIG. 11, this sequencer embodiment may be conveniently divided into three separate sequencer circuits which are labeled as the state sequencer, the initiate sequencer and V/UV sequencer.

The $\overline{\text{SYS CLK}}$ signal generated by the initiate sequencer starts as the $\overline{\text{TRNS DTA}}$ signal goes to the logically high level at the conclusion of a particular data block transfer. The first $\overline{\text{SYS CLK}}$ pulse sets state 1 flip-flop 251. As state 1 flip-flop changes state, state 0 is automatically reset through gate 255. The end of the next $\overline{\text{SYS CLK}}$ pulse resets state 1 flip-flop 251, thus setting state 2 flip-flop 252. In the same manner, the next $\overline{\text{SYS CLK}}$ pulse resets state 2 flip-flop 252 and sets state 3 flip-flop 253. Until the complete autocorrelation calculation has been performed (as indicated by the CORR COMPLT signal) the next $\overline{\text{SYS CLK}}$ pulse will reset state 3 flip-flop 253 and set state 1 flip-flop 251. When the entire autocorrelation computation is completed, the CORR COMPLT signal applied to one input terminal of NAND gate 257 is in the logical high condition and state 4 flip-flop 254 is set through NAND gate 257 and inverter 258 by the next $\overline{\text{SYS CLK}}$ pulse.

The initiate sequencer provides the previously described control signals which initialize the autocorrelation processor during state 0. In addition, the initiate sequencer enables the voiced/unvoiced (V/UV) sequencer. Once enabled, the V/UV sequencer in cooperation with the initiate sequencer generates the V/UV control signals and controls the internal clock source of FIG. 18 to supply the $\overline{\text{SYS CLK}}$ control signal and the % CLK control signal during appropriate time intervals of the V/UV state period.

The $\overline{\text{TRNS DTA}}$ signal resets the initiate and V/UV sequencers to start the initiate sequence. Pulse synchronization is provided between the $\overline{\text{MSTR CLK}}$ signal which is generated by the internal clock circuit of FIG. 18 and the transition of the asychronous $\overline{\text{TRNS DTA}}$ signal by flip-flops 261 and 262. As can be seen in FIG. 11, as the $\overline{\text{TRNS DTA}}$ signal enters the logically high state, the $\overline{\text{MSTR CLK}}$ signal sets flip-flop 261 and enables NAND gate 263. The next MSTR CLK pulse is coupled through NAND gate 263 to generate the $\overline{\text{TRNS DTA PULSE A}}$ signal and sets flip-flop 262. Setting flip-flop 262 prevents the further generation of pulses at the output of gate 263 ($\overline{\text{TRNS DTA PULSE A}}$ pulses). In the timing diagram of FIG. 11 the $\overline{\text{TRNS DTA PULSE A}}$ signal is depicted as the CLK A signal. As previously described CLK A is utilized by the control logic of FIG. 12 to generate a number of control signals which initialize the autocorrelation processor registers. When the 300 data words have been transferred from the clipping processor to the autocorrelation processor by the next 300 pulses of the DTA CLK signal, flip-flops 261 and 262 are cleared through NAND gate 266 and inverter 267 by the $\overline{\text{TRNS DTA}}$ signal. As the transfer of the 300 data word data block is completed, the $\overline{\text{TRNS DTA}}$ signal returns high and the previously described system CLK X pulse is generated.

The CLK X pulse resynchronizes the transition of the $\overline{\text{TRNS DTA}}$ signal with the $\overline{\text{MSTR CLK}}$ signal. Referring to FIG. 11, it can be seen that the MSTR CLK signal is inverted by inverter 269 and applied to the clock input of flip-flop 268. Thus flip-flop 268 is set by the first MSTR CLK pulse following the positive transition of the $\overline{\text{TRNS DTA}}$ signal. Setting flip-flop 268 enables gate 271 and the MSTR CLK signal is coupled through NAND gates 271 and 276 and inverters 272 and 274 to provide the SYS CLK and $\overline{\text{SYS CLK}}$ signals. The $\overline{\text{CLK X}}$ signal, which is also utilized as the $\overline{\text{CLR CNTR A}}$ signal and $\overline{\text{CLR CNTR B}}$ signal, is supplied by NAND gate 273. Since the trailing edge of the first $\overline{\text{SYST CLK}}$ pulse causes the state sequencer to switch the autocorrelation processor into operational state 1, NAND gate 273 is disabled during subsequent pulses of the MSTR CLK signal. As shown in FIG. 11, flip-flop 268 is reset via NAND gate 278 and inverter 277 by the $\overline{\text{TRNS DTA}}$ signal and the $\overline{\text{MCL}}$ signal.

The $\overline{\text{TRNS DTA}}$ signal also sets the V/UV state flip-flop 281 and sets clock counter 282 to enable the $\overline{\%\text{ LD}}$ control signal at inverter 283. Following the system clock CLK X signal, the SYS CLK signal continues throughout that portion of the V/UV interval in which the autocorrelation value at zero lag is computed for determining the V/UV threshold level. When the calculation of the zero lag is complete, the ELE COMPLT signal and the STATE 3 control signal are combined by NAND gate 286 to clear flip-flop 287. Clearing flip-flop 287 redirects the MSTR CLK signal to generate the $\overline{\%\ CLK}$ control signal by disabling NAND gate 276 and enabling NAND gate 291. The % CLK pulses which are supplied from NAND gate 291 by the operation of inverter 292, control the operation of the V/UV circuit depicted in FIG. 17. The $\overline{PITCH\ CL}$ control signal and the $\overline{CORR\ CL}$ control signal, also utilized in the V/UV circuit of FIG. 17, are supplied by NAND gate 293 and inverter 294.

Figure 16:
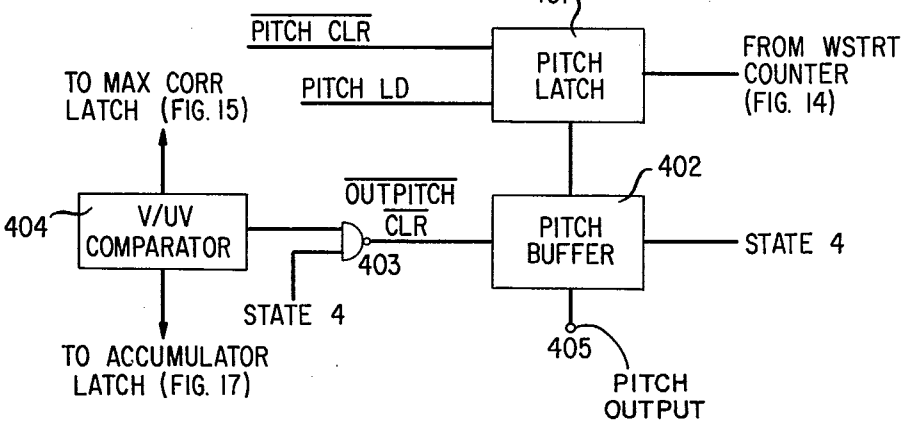
FIG. 16 depicts circuitry for storing the maximum autocorrelation value and circuitry for suppressing pitch output signals during unvoiced speech intervals in the illustrative embodiment of this invention.
Figure 17:
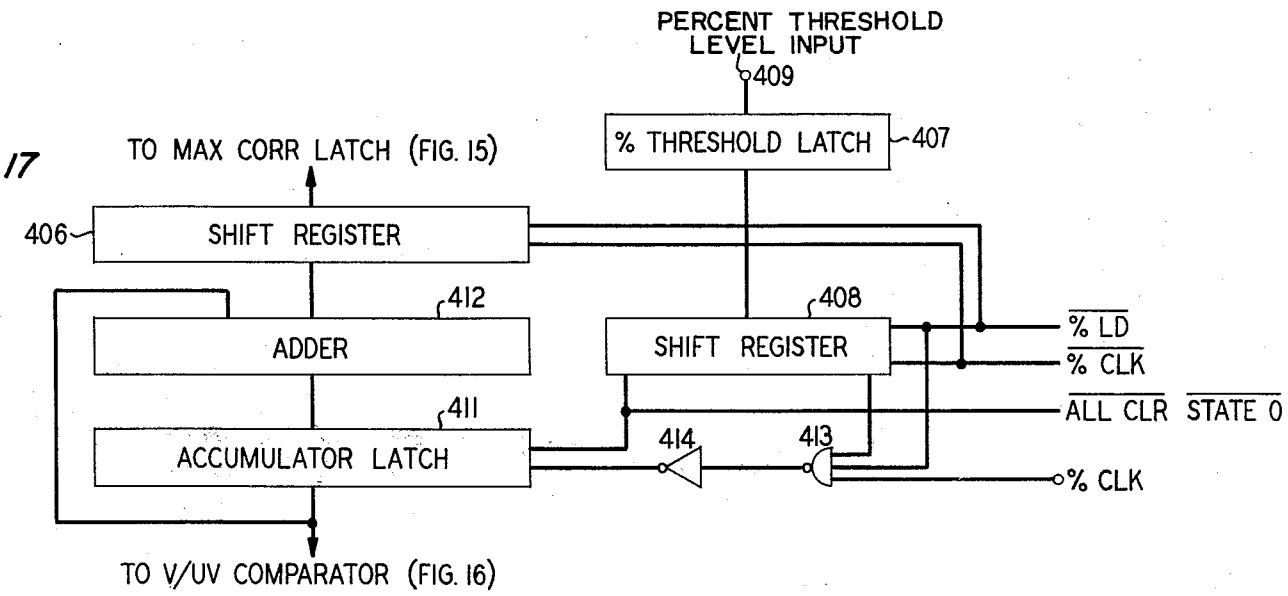
FIG. 17 schematically depicts a circuit utilized in the illustrative embodiment of this invention to determine the voice-unvoiced threshold.

The first $\overline{\%\ CLK}$ pulse loads the autocorrelation zero lag peak into the arithmetic unit of the V/UV circuit of FIG. 17 and clears the $\overline{\%\ LD}$ signal generated by clock counter 282 at inverter 283. As shown in FIG. 11, the $\overline{\%\ CLK}$ signal is coupled to clock counter 282 via NAND gate 288 and inverter 289. The fifth pulse of the $\overline{\%\ CLK}$ signal generates the $\overline{V/UV\ CLK}$ signal by combining the appropriate output bits of clock counter 282 with the $\overline{\%\ CLK}$ signal at NAND gate 284. The $\overline{V/UV\ CLK}$ signal clears the autocorrelation processor pitch latch (FIG. 16) and resets the correlation or U/D counter (FIG. 15), thus initializing the autocorrelation processor for the autocorrelation computation through the lag range $M_i$ to $M_f$ of Equation 2. The $\overline{V/UV\ CLK}$ signal also resets V/UV flip-flop 281 which in turn resets flip-flop 287. Resetting flip-flop 287 again enables the $\overline{SYS\ CLK}$ signal which completes the autocorrelation processor initialization sequence. It should be noted that due to space limitiation the timing diagram of FIG. 10 does not illustrate the above-described disabling of the SYS CLK signal during that portion of the V/UV state in which the percent of the zero lag is calculated.

Figure 12:
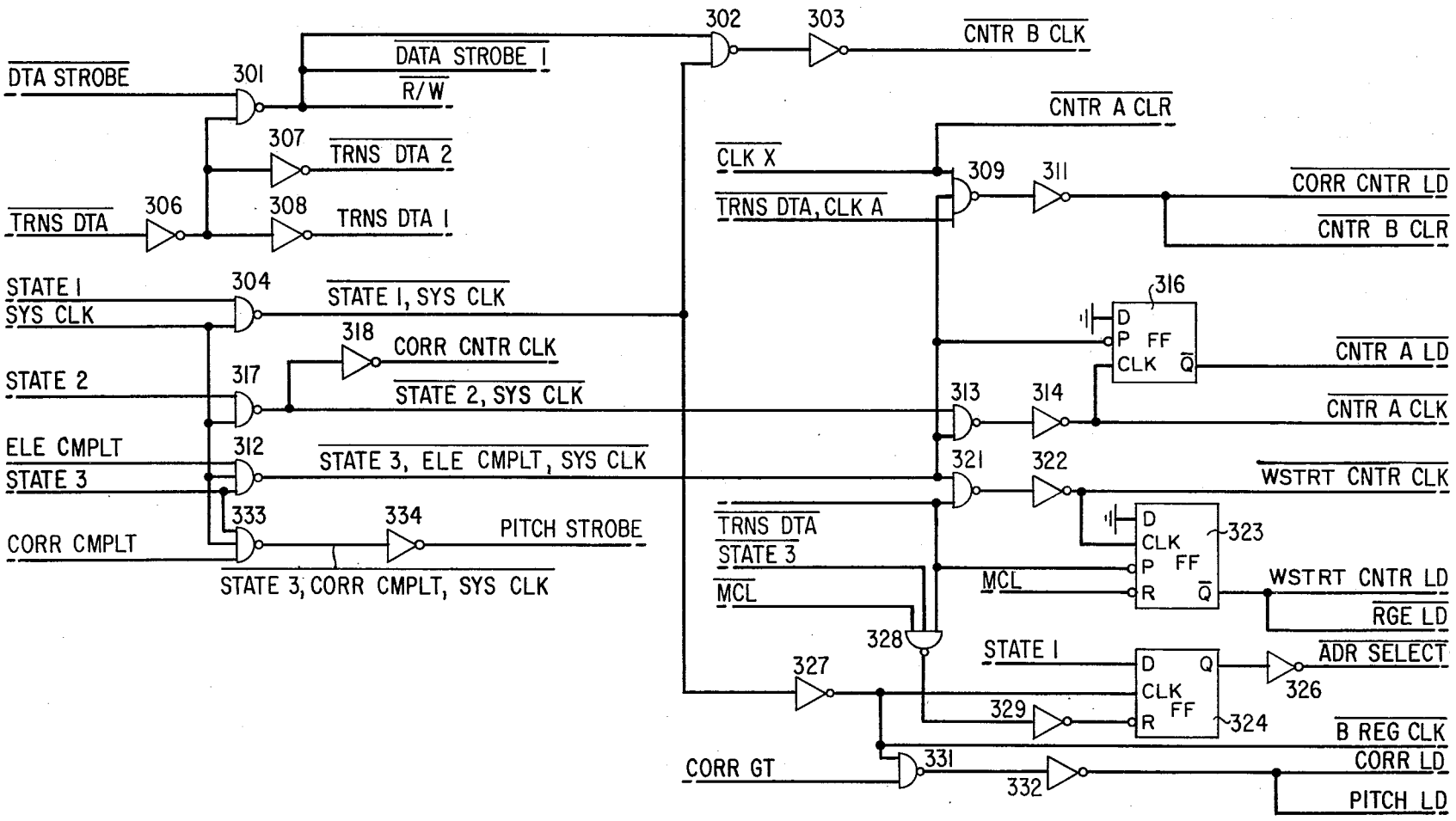
FIG. 12 depicts a control logic circuit suitable for generating the control signals of FIG. 10 which operate the autocorrelation processor of the illustrated embodiment of this invention.

The control logic circuit of FIG. 12 combines the system status indicators (STATE 1, 2 and 3 signals, the ELE CMPLT and CORR CMPLT signals) with clock signals, the DATA STROBE signal, and the $\overline{TRNS\ DTA}$ signal to load, clear, and clock the autocorrelation processor registers. As can be recognized from the previous discussion of the operation of the autocorrelation processor, the signals generated by the control logic circuit provide the initialization and updating required for the pitch computation.

The $\overline{DTA\ STROBE}$ signal applied to NAND gate 301 provides the $\overline{R/W}$ signal to the memory circuit of FIG. 13. The $\overline{CNTR\ B\ CLK}$ signal, which increments memory address counter 347 of FIG. 13 during the data load sequence, is supplied by NAND gate 302 and inverter 303. The $\overline{CNTR\ B\ CLK}$ signal (utilized to increment memory address counter 347 during state 1) is supplied by NAND gate 304, the output terminal of which is connected one input terminal of NAND gate 302. Since NAND gate 304 is responsive to the STATE 1 control signal and the SYS CLK signal, the $\overline{CNTR\ B\ CLK}$ pulse during state 1 is coincident with the SYS CLK pulse.

Inverters 306, 307 and 308 provide fan out of the $\overline{TRNS\ DTA}$ signal to drive the sequencer circuit depicted in FIG. 11.

The $\overline{CNTR\ B\ CLR}$ signal (and the $\overline{CORR\ CNTR\ LD}$ signal) is generated by NAND gate 309 and inverter 311 to clear memory address counter 347 of FIG. 13 whenever either the $\overline{CLK\ X}$ signal, the $\overline{STATE\ 3\ .\ ELE\ COMPLT\ .\ SYS\ CLK}$ signal or the $\overline{TRANS\ DTA\ .\ CLK\ A}$ signal is generated. As shown in FIG. 12, the $\overline{STATE\ 3\ .\ ELE\ CMPLT\ .SYS\ CLK}$ signal (supplied by NAND gate 312) is also coupled through NAND gate 313 and inverter 314 to set flip-flop 316. Setting flip-flop 316 generates the $\overline{CNTR\ A\ LD}$ signal to load memory address counter 352 of FIG. 13. Since memory address counter 352 is a synchronous, the $\overline{CNTR\ A\ LD}$ signal must remain low as the counter is clocked by the $\overline{CNTR\ A\ CLK}$ signal which is provided at the output of inverter 314. Since flip-flop 316 is cleared by the trailing edge transition of the $\overline{STATE\ 3\ .\ ELE\ CMPLT\ .\ SYS\ CLK}$ signal, this condition is satisfied. $\overline{CNTR\ A\ CLK}$ pulses are also provided by the $\overline{STATE\ 2\ .\ SYS\ CLK}$ signal which is generated by NAND gate 317. The $\overline{STATE\ 2\ .\ SYS\ CLK}$ signal is inverted by inverter 318 to supply the CORR CNTR CLK signal which controls the correlation counter of FIG. 15.

Snychronization similar to that utilized in producing the $\overline{CNTR\ A\ LD}$ signal is used to supply the $\overline{RGE\ LD}$ and the $\overline{WSTRT\ CNTR\ LD}$ signals. As shown in FIG. 12, NAND gate 321 and inverter 322 set flip-flop 323 and also generate the $\overline{WSTRT\ CNTR\ CLK}$ signal in response to the $\overline{TRNS\ DTA}$ signal to load WSTRT counter 346 of FIG. 13. In addition, the WTSRT counter is incremented by the $\overline{STATE\ 3\ .\ ELE\ CMPLT\ .\ SYS\ CLK}$ signal which is connected to a second input terminal of NOR gate 321. Although the range latch of FIG. 13 does not require synchronization the WSTRT counter is conveniently loaded by the $\overline{WSTRT\ CNTR\ LD}$ signal which is also generated by flip-flop 323.

Figure 15:
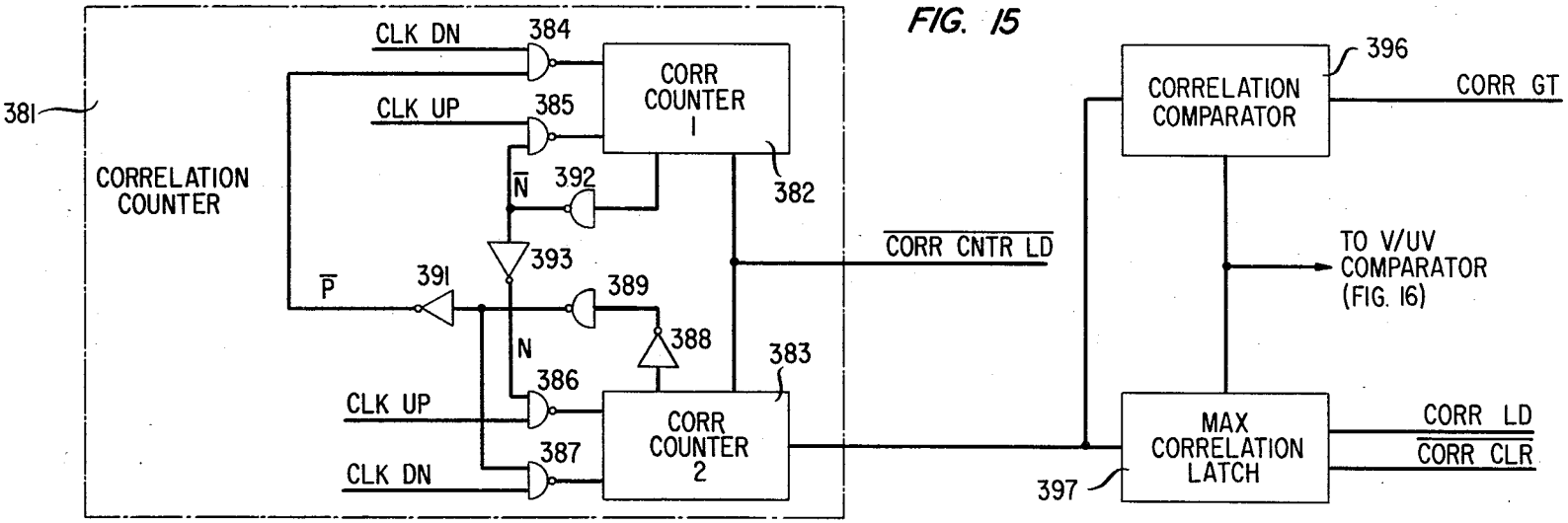
FIG. 15 depicts the correlation counter of the illustrative embodiment of this invention.

The control of the selector circuit of FIG. 13 to establish address selection from either memory address counter 352 or memory address counter 347 is implemented by flip-flop 324 and the associated gates depicted in FIG. 12. The $\overline{ADR\ SELECT}$ signal supplied at the output of inverter 326 enables memory address counter 347 when the $\overline{TRNS\ DTA}$ is activated. At the end of state 1, flip-flop 324 is set by the $\overline{STATE\ 1\ ,\ SYS\ CLK}$ signal which is coupled through inverter 327. Setting flip-flop 324 produces a logically low $\overline{ADR\ SELECT}$ signal at the output of inverter 326 which activates memory address selector 351 of FIG. 13 to connect memory address counter 352 to the memory unit. Flip-flop 324 is reset during state 3 by means of NAND gate 328 and inverter 329 to thereby enable memory address counter 347, just prior to the state 1 memory access. The $\overline{B\ REG\ CLK}$ signal, which is utilized by the correlation counter of FIG. 15, is supplied by inverter 327 during the final portion of the state 1 control signal. The PITCH LD signal and the CORR LD signal are supplied by NAND gate 331 and inverter 332 to respectively load the pitch latch circuit of FIG. 16 and the correlation latch circuit of FIG. 15. NAND gate 333 and inverter 334 supplies the PITCH STROBE signal depicted in FIG. 10.

In the illustrative embodiment of this invention, the values of the initial and final lag elements ($M_i$ and $M_f$ of Equation 2) are respectively applied to terminals 341 and 342 of FIG. 13 and are strobed into WSTRT latch 343 and WEND latch 344 prior to commencing the speech analysis. Although it can be recognized that in some applications fixed values of $M_i$ and $M_f$ can be utilized, the use of latches 343 and 344 is advantageous in situations wherein it is desirable or necessary to control the lag range to adapt to different speakers. Such control, accomplished by the manual strobing process defined above, or accomplished by adaptively determining the proper lag range based on the speech being processed, minimizes the number of calculations required during the autocorrelation calculation process.

In the circuit of FIG. 13, WSTRT counter 346 is initially loaded from WSTRT latch 343 by the $\overline{WSTRT}$ $\overline{\text{CNTR LD}}$ signal at the conclusion of state 0 and is incremented after the autocorrelation function is computed at each lag element by the $\overline{\text{WSTRT CNTR CLK}}$ signal. As previously discussed, the $\overline{\text{WSTRT CNTR LD}}$ and the $\overline{\text{WSTRT CNTR}}$ signal are provided by the control logic of FIG. 12.

During state 0, memory address selector 351 is set such that memory address counter 347 is connected to the addressing logic of autocorrelation memory unit 354. Address counter 347 is incremented by the $\overline{\text{CNTR B CLK}}$ signal to access a new storage location prior to the arrival of the next data word ($\overline{I_0}$ and $\overline{I_1}$) from clipper 117 of the clipping processor embodiment of FIG. 4. The value remaining in address counter 347 after loading the final data word from the 300 data word analysis interval is loaded into range latch 348 by the $\overline{\text{RGE LD}}$ signal at the conclusion of state 0. This value is utilized to detect completion of the calculation of the autocorrelation function at each particular lag element. As the autocorrelation processor enters state 1, memory address counter 347 is cleared by the $\overline{\text{CNTR B CLR}}$ signal.

When the autocorrelation processor is operating in the V/UV state, memory address counter A 352 is initially cleared by the $\overline{\text{CNTR A CLR}}$. The autocorrelation processor then cycles between states 1, 2 and 3 to calculate the value of the autocorrelation function at zero lag. During state 1, memory address selector 351 is activated so that address counter 347 accesses memory unit 354 and the access data word is loaded into B register latch 357 of combinational logic circuit 356. During state 2, address selector 351 is activated so that address counter 352 accesses memory unit 354 and the accessed data word is combined with the data word stored in B register latch 357 to produce the clock up/clock down signal which controls the correlation counter of FIG. 15. During state 3, the value of the digital word stored in range latch 348 is compared with the incremented count contained in memory address counter 352 by element comparator 349. When the two quantities are equal, the autocorrelation calculation at that particular lag element is complete and element comparator 349 generates the ELE CMPLT signal which is coupled to the sequencer circuit and control logic circuit of FIGS. 11 and 12 respectively.

After the determination of the V/UV threshold during the V/UV state, counter 352 is loaded from the WSTRT counter 346. The autocorrelation processor then cycles through states 1, 2 and 3 as described above until the calculation is completed at the first lag element.

Upon the generation of the $\overline{\text{ELE CMPLT}}$ signal by element comparator 349, WSTRT counter 346 is incremented by the $\overline{\text{WSTRT CNTR CLK}}$ signal and the new value is loaded into address counter 352 by the $\overline{\text{CNTR A LD}}$ signal to start the calculation at the next lag element. When the value of the new lag element is loaded into counter 352, counter 347 is cleared by the $\overline{\text{CNTR B CLR}}$ signal. This sequence continues until the calculation is completed at each lag element. Completion of the entire autocorrelation calculation is detected during state 3 by CORR CMPLT comparator 353 which compares the value contained in WEND latch 344 with the incremented count of WSTRT counter 346. When these values are equal, the correlation calculation for the block of 300 data words is complete and comparator 353 generates the CORR CMPLT signal placing the autocorrelation processor in state 4 where it remains until a new data block arrives from the clipping processor.

The autocorrelation memory circuit depicted in FIG. 12 is a combination of four one bit by 256 word commercially available memory circuits which provides a two bit by 512 word configuration capable of storing the 300 two bit data words supplied by the clipping processor. In one realization of autocorrelation memory circuit 354, Schottky bipolar memories 82S06 manufactured by Signetics, Inc. were employed. In the operation of the depicted autocorrelation memory, the most significant bit of the address word generated by memory address counter 352 or memory address counter 347 and coupled to memory 354 by memory address selector 351 is connected to inverter 366 to select either memory circuit pair 361–362 or memory circuit pair 363-364. As shown in FIG. 13, the $\overline{I_0}$ bits of the 300 two bit data words generated by clipper 117 of the clipping processor are stored in memory circuits 362 and 364 and $\overline{I_1}$ bits are stored in memory circuits 361 and 363. During the previously discussed data loading sequence of state 0, the $\overline{I_0}$ and $\overline{I_1}$ data bits are loaded into memory 354 when $\overline{\text{R/W}}$ signal is in the low state.

As each stored data word is accessed the $\overline{I_0}$ bit of the access data word is coupled to combinational logic 356 as the $D_0$ bit and the $\overline{I_1}$ bit is coupled to combinational logic 356 as the $D_1$ bit. The two bit data word coupled to combinational logic 356 during state 1 by the operation of memory address counter 347 and memory address selector 351 is held in B register latch 357. The B REG CLK signal generated by the control logic of FIG. 12 loads the data word into B register latch 357. The second data word is addressed by selector 351 and memory address counter 352 during state 2. Since the $D_0$ and $D_1$ bits which comprise this digital word remain stable at the output terminals of memory unit 354, the data does not require a latch circuit. Thus it can be seen that a first data word which corresponds to the term $x(n)$ in Equation 2, is placed in B register latch 357 during each state 1 interval and a second data word which corresponds to $x(n+m)$ arrives at the memory output during each state 2 interval. The two bits of the digital word contained in B register latch 357, which are denoted $B_0$ and $B_1$ respectively in FIG. 13, and $D_0$ and $D_1$ bits of the digital word arriving in state 2 are coupled to NAND gates 367, 368, 369 and 370 as shown in FIG. 13. In addition, the CORR CNTR CLK signal generated by the sequencer circuit of FIG. 11 is connected to each of these NAND gates. The CORR CNTR CLK signal which is generated during state 3 provides synchronization by enabling NAND gates 367, 368, 369 and 370 for one pulse period. NAND gtes 367, 368, 369 and 370, in conjunction with NAND gates 371 and 372 generate the logic operations $D_0B_1 + D_1B_0$ to produce a clock down signal and $D_1B_1 + D_0B_0$ to produce a clock up signal.

Figure 14:
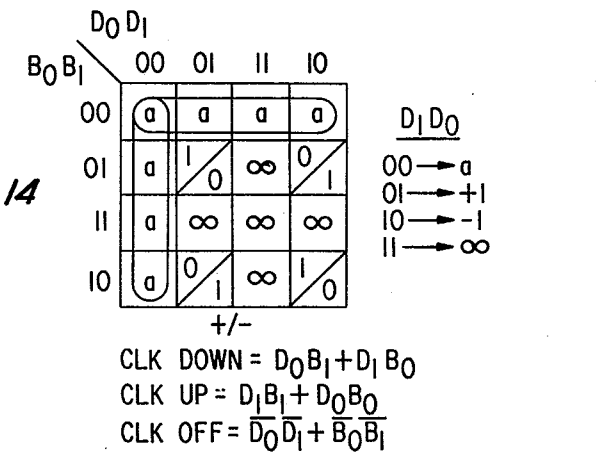
FIG. 14 is a Karnaugh map which describes the operation of the combinational logic circuit of FIG. 13.

FIG. 14 depicts a Karnaugh map for the combinational logic of FIG. 13. In FIG. 14 the condition which results when either of the data words consist of two binary ones is declared a "don't care" state since clipper 117 of the clipping processor embodiment of FIG. 4 does not generate a 11 signal.

FIG. 15 depicts a circuit arrangement utilized in the illustrative embodiment of this invention which accumulates the count up/count down pulses generated by the combinational logic in order to determined the value of the autocorrelation function at each of the lag elements. Additionally FIG. 15 depicts the correlation comparator and maximum correlation latch which detect maximum value of the autocorrelation function as the processor cycles through the calculation at each lag element.

Referring to FIG. 15, it can be seen that correlation counter 381 includes first and second counters 382 and 383. The use of two separate counters avoids the substantial propagation delay which would generally occur if a single counter circuit is employed. The operation of counter 382 is controlled by NAND gates 384 and 385 and the operation of counter circuit 383 is controlled by NAND gates 386 and 387. NAND gates 384, 385, 386 and 387 are enabled by the N, $\overline{N}$, P and $\overline{P}$ signals as shown in FIG. 15. The P signal is supplied by inverter 388 and NAND gate 389. Although inverter 388 is shown as a single inverter unit in FIG. 15, inverter 388 is in fact a plurality of inverter circuits which provides a single inverter circuit for each counter bit of counter 383. The output signals of these inverters are connected to the input terminals of NAND gate 389 which supplies the P signal. The $\overline{P}$ signal is supplied by inverter 391. The N and $\overline{N}$ signals are derived from the bit signals of counter 282 by NAND gate 392, the input terminals of which are connected to each bit location of counter 382. The N signal supplied at the output terminal of NAND gate 392 is inverted by inverter 393 to supply the N signal. By examining this configuration, it can readily be seen that a logically low or false P signal is supplied only when each bit of the count contained in counter 383 is false (logical zero) and a positive or true N signal is supplied only when each bit of the count contained in couner 382 is true (logical one). The $\overline{\text{CORR CNTR LD}}$ signal, generated by the control logic circuit of FIG. 12, initializes correlation counter by resetting counters 382 and 383 such that the counter bits of counter 382 are true and all of the counter bits of counter 383 are false. Thus it can be seen that correlation counter 381 is effectively two counters each clocked by separate up/down clock signals which are controlled by the N and P signals.

For example, if a clock up signal is generated by the combinational logic of FIG. 13 when all bits of counter 383 are not false ($P=1$, $\overline{P}=0$), then N must equal zero and only counter 381 receives the clock up signal. By examining FIG. 15 it can be seen that at the conclusion of the autocorrelation calculation counter 381 will contain a count indicative of the value of the autocorrelation function at that lag element being processed. The output terminals of counter 383 are coupled to the input terminals of correlation comparator 396 and max correlation latch 397 which detects the maximum value of the autocorrelation function over the entire lag range. Comparator 396 and maximum correlation 397 are conventional digital circuits arranged in the same manner as the comparator-latch circuits containing max peak latches 94 and 97 and peak comparators 93 and 96 in the clipping processor embodiment of FIG. 4.

The $\overline{\text{CORR CLR}}$ signal generated by the sequencer circuit of FIG. 12 at the beginning of the calculation sequence at each particular lag element (generated during the reset operation from state 4 to state 0) resets maximum correlation latch 397 so that it contains a digital word having the value zero. As the value of the autocorrelation function at each lag element is detected by correlation counter 381, correlation comparator 396 compares the value of the digital word supplied by the correlation counter with the digital word contained in latch 397. If the incoming digital word is greater than the digital word contained in latch 397, comparator 396 generates the CORR GT signal which in turn supplies the CORR LD and PITCH LD signal by means of the control logic circuit of FIG. 12. The CORR LD signal loads the new larger incoming data word into latch 397. Thus, as the autocorrelation processor cycles through the calculation of the autocorrelation function at each lag element, max correlation latch 397 holds the maximum value of the autocorrelation function at the previously computed lag elements. Accordingly, when the autocorrelation calculation is complete, latch 397 contains a digital word representative of the maximum autocorrelation value throughout the calculated lag range.

As shown in FIG. 16, the PITCH LD signal is coupled to pitch latch 401 which is a conventional digital latch circuit. The input terminals of pitch latch 401 are connected to the WSTRT counter 346 of FIG. 13. When the PITCH LD signal is generated in response to the CORR GT signal, the count contained in WSTRT counter 346 is loaded into pitch latch 401. As previously discussed, WSTRT counter 346 contains the starting address which was used to access the autocorrelation processor for the calculation at the lag element which generated the CORR GT signal. Thus the digital word at the conclusion of the autocorrelation sequence, the digital word contained in pitch latch 401 can be interpreted as the pitch period based on the 10KHz sampling rate of this embodiment. Pitch latch 401 is cleared by the $\overline{\text{PITCH CLR}}$ signal generated by the sequencer circuit of FIG. 11.

The resulting pitch data is coupled from pitch latch 401 to pitch buffer 402 which is conventional digital circuit such as a latch circuit. Pitch buffer 402 is loaded with the pitch information contained in pitch latch 401 in response to the STATE 4 control signal which, as previously discussed with respect to the sequencer circuit of FIG. 11, is generated at the completion of the autocorrelation calculation. The output of pitch buffer 402 is coupled to pitch output terminal 405. Thus when the autocorrelation calculation is complete, pitch buffer 402 contains the pitch period of the 300 millisecond speech analysis interval. Pitch buffer 402 is cleared by the $\overline{\text{OUTPITCH CLR}}$ signal generated by NAND gate 403 whenever the calculated maximum autocorrelation value does not exceed the V/UV threshold level.

V/UV comparator 404 compares the maximum value of the autocorrelation function contained in max correlation latch 397 of FIG. 15 with the V/UV threshold. As previously noted, the V/UV threshold may be a digital word contained in a conventional register circuit (FIG. 1) or may be an adaptively determined threshold contained in an accumulator or register circuit such as the circuit of FIG. 17. In any case, during state 4 the output of comparator 404 generates an $\overline{\text{OUTPITCH CLR}}$ signal via NAND gate 403 which clears pitch buffer 402 to thereby suppress the output of the pitch data whenever the calculated maximum autocorrelation value does not exceed the V/UV threshold level.

FIG. 17 depicts an embodiment of a circuit for determining the V/UV threshold as a predetermined percentage or portion of the value of the autocorrelation function at the zero lage element. As previously discussed, this calculation is performed during the V/UV state. The circuit arrangement of FIG. 17 is similar to the arrangement of energy and clipping level arithmetic unit 82 of the clipping processor embodiment depicted in FIG. 4. It can be noted, however, that a selector circuit is not required in the circuit of FIG. 17 since the circuit does not process data from two separate data sources.

In the circuit of FIG. 17, the peak autocorrelation value contained in max correlation latch 397 of FIG. 15 at the conclusion of the zero lag calculation is loaded into shift register 406 and the desired percentage multiplier contained in % threshold latch 407 is loaded in the shift register 408. The percentage threshold level contained in latch 407 is determined prior to the speech analysis and may be loaded into latch 407 by any conventional means. For example, the speech analyzer operator may strobe a data word representing the percentage threshold level into latch 407 via input terminals 409. In any case, shift registers 406 and 408 are loaded by the $\overline{\%\ CLK}$ pulse which occurs while the $\overline{\%\ LD}$ signal is in a logical low state. As previously discussed, the $\overline{\%\ LD}$ and the $\overline{\%\ CLK}$ signals are generated by the V/UV sequencer circuit of FIG. 11. $\overline{\%\ CLK}$ pulses occurring when the $\overline{\%\ LD}$ signal is high, shift the data words through shift registers 406 and 408 to perform the shift-and-add operation which effectively multiplies the autocorrelation zero lag value by the percent threshold level. The circuit of FIG. 17 operates in a manner similar to arithmetic unit 82 of FIG. 4 in that after shift registers 406 and 408 are loaded, the value in shift register 406 is added to the value in accumulator latch 411 by means of adder 412 whenever the binary bit at the output of shift register 408 is logically true (a digital 1) and the data is then shifted by one location within shift registers 406 and 408 by the combined $\overline{\%\ LD}$ and $\overline{\%\ CLK}$ signal. Accumulator latch 411 is cleared by the $\overline{ACC\ CLR}$ signal prior to the computation of the V/UV threshold. NAND gate 413 and inverter 414 combine the $\overline{\%\ CLK}$, the $\overline{\%\ LD}$ signal, and the binary output bit of shift register 408 to load accumulator latch 411. As can be determined from the circuit of FIG. 17, the $\overline{\%\ LD}$ signal disables the strobing of accumulator latch 411 during the loading of the shift registers. Thus, like arithmetic unit 82 of FIG. 4, setting the percentage multiplier into a four bit configuration results in an output from accumulator latch 411 which is a combination of 1, ½, ¼, or ⅛ times the value of the autocorrelation value at zero lag.

FIG. 18 depicts an internal clock source which satisfactorily supplies the $\overline{MSTR\ CLK}$ signal for the clipping processor and the MSTR CLK signal for the autocorrelation processor of this illustrative embodiment. In FIG. 18, circuit 416 is a conventional digital clock source, such as the circuit commercially available as the SN74S124. Such a circuit generally includes operational amplifier 417, which is connected to oscillate at a frequency determined by external feedback 419. This oscillator drives flip-flop 418 to produce a digital clock signal. In one realization of the illustrative embodiment of this invention, this circuit was utilized to establish a MSTR CLK signal for the autocorrelation processor having a frequency of 13 MHz. The $\overline{MSTR\ CLK}$ signal which is formed by counting down from the autocorrelation processor MSTR CLK signal is supplied by counter 421 and NAND gate 422. In the realization in which the autocorrelation MSTR CLK signal was 13 MHz, a 1.6 MHz clipping processor $\overline{MSTR\ CLK}$ signal was employed. Although it will be recognized by those skilled in the art that a variety of clock rates may be employed in the practice of this invention, it should be further recognized that operation at speech sampling rates on the order of 10 KHz does not necessitate a crystal controlled clock. Further, incoming data rates which greatly exceed 10 KHz are possible by the use of high speed digital circuits in the previously described embodiments.

What is claimed is:

1. A speech analyzer for continuously determining the pitch period of an applied speech signal comprising:

means for dividing said speech signal into a succession of intervals, each of said intervals including a predetermined number of digitally encoded speech samples;

clipping means responsive to an applied clipping level signal for clipping n consecutive intervals of said applied speech signal, said clipping means supplying a first predetermined signal for positive speech samples of a magnitude which exceeds said applied clipping level signal, said clipping means supplying a second predetermined signal for negative speech samples of a magnitude which exceeds said applied clipping level signal, said clipping means supplying a third predetermined signal for speech samples of magnitude less than said applied clipping level signal;

means for adjusting said clipping level signal in response to the peak signal samples within preselected ones of said n consecutive intervals of applied speech; autocorrelation means responsive to said first, second and third predetermined signals supplied by said clipping means for determining the value of the autocorrelation function of said n consecutive speech intervals at a plurality of predetermined lag elements; and means responsive to the peak value of said autocorrelation function for supplying a signal indicative of said pitch period.

2. The speech analyzer of claim 1 further comprising means for suppressing said pitch period signal whenever said peak value of said autocorrelation function is less than a first predetermined threshold value.

3. The speech analyzer of claim 2 wherein said first predetermined threshold is a fractional portion of the autocorrelation value at the zero lag element.

4. The speech analyzer of claim 1 wherein said clipping means includes means for supplying said third predetermined signal for speech samples of a magnitude less than a second predetermined threshold value.

5. The speech analyzer of claim 4 wherein said second predetermined threshold value is the maximum valued sample of a predetermined interval of silence in which a signal corresponding to the environmental background noise is applied to said speech analyzer.

6. The speech analyzer of claim 1 wherein said clipping level adjusting means establishes said applied clipping level as a predetermined fractional portion of the least valued peak speech sample within said preselected plurality of said $n$ consecutive speech intervals.

7. The speech analyzer of claim 6 wherein $n$=3 and said preselected plurality of said three speech intervals are the first and third intervals of said three consecutive speech intervals.

8. A speech analyzer for determining the pitch period of a digitally encoded speech interval comprising:

clipping means for supplying a clipped signal in response to each digitally encoded speech sample of said digitally encoded speech interval, said clipped signal having a first predetermined value if the speech sample is positive and of a magnitude which exceeds a predetermined clipping level, said clipped signal having a second predetermined value if said speech sample is negative and of a magnitude which exceeds said predetermined clipping level, said clipped signal having a third predetermined value if said magnitude of said speech sample does not exceed said magnitude of said predetermined clipping level;

storage means for storing a plurality of said clipped signals supplied by said clipping means;

addressing means for sequentially accessing preselected pairs of said clipped signals within said storage means;

combinational logic means for supplying a first predetermined signal if any one of the clipped signals of said accessed preselected pair of signals is of said third predetermined signal when one of said clipped signals of said preselected pair of signals is of said first predetermined value and the other clipped signal of said preselected pair of signals is of said second predetermined value, said combinational logic means supplying a third predetermined signal if both clipped signals of said preselected pair of signals are of said first predetermined value, said combinational logic means further supplying said third predetermined signal if both clipped signals of said predetermined pair of signals are of said second predetermined value; and means for accumulating the signals supplied by said combinational logic means as said address means sequentially accesses said predetermined pairs of signals, said accumulating means supplying an output signal indicative of the number of said third predetermined signals supplied by said combinational logic means minus the number of second predetermined signals supplied by said combinational logic means.

9. The speech analyzer of claim 8 further comprising means for establishing said clipping level on the basis of the speech samples within said speech interval.

10. The speech analyzer of claim 9 wherein said means for establishing said clipping level includes means for subdividing said speech interval into a predetermined number of subintervals, means for determining the maximum value speech sample within each one of a preselected number of said subintervals, means for selecting the smallest valued speech sample of said maximum valued speech samples and means for multiplying sai smallest valued speech sample by a predetermined decimal fraction.

11. The speech analyzer of claim 10 wherein said speech interval is subdivided into three subintervals of substantially identical duration and said clipping level is a predetermined decimal fraction of the lesser of the maximum valued speech samples within the first subinterval and the maximum valued speech sample within the third subinterval.

12. The speech analyzer of claim 8 further comprising means for determining periods of silence within said speech interval, said silence determination means including means for comparing the maximum valued speech sample within each speech interval with a predetermined silence threshold.

13. The speech analyzer of claim 12 wherein said silence threshold is the maximum valued speech sample determined by said speech analyzer during a predetermined interval of time in which said speech analyzer is subjected to the environmental background noise.

14. The speech analyzer of claim 8 further comprising means for determining the speech energy of said speech interval, said energy determining means including summation means for determining the sum of the absolute values of said digitally encoded speech samples.

15. The speech analyzer of claim 8 further comprising means for determining whether said speech signal is voiced or unvoiced during said speech interval, said voiced-unvoiced determination means including means for comparing said output signal of said accumulating means with a predetermined voiced-unvoiced threshold.

16. The speech analyzer of claim 15 wherein said voiced-unvoiced threshold is a predetermined fractional portion of the output signal of said accumulating means when said addressing means sequentially accesses pairs of clipped data which correspond to the zero autocorrelation lag calculation.

17. A speech analyzer for real time determination of the pitch period of a digitally encoded speech signal comprising;

means for subdividing a predetermined interval of said speech containing N digitally encoded speech samples $s(n)$, $n$=0, 1,..., N-1 into $k$ subintervals, each of said $k$ subintervals containing a substantially equal number of said N digitally encoded speech samples;

clipping means responsive to each speech sample $s(n)$, $n$=0, 1, . . . , N-1 and a predetermined clipping threshold signal for supplying N digital words $x(n)$, $n$=0, 1, . . . , N-1, said clipping means supplying a first digital word when said speech sample $s(n)$ is positive and of greater magnitude than said clipping threshold signal, said clipping means supplying a second digital word when said speech sample $s(n)$ is negative and of greater magnitude than said clipping threshold signal, said clipping means supplying a third digital word when said magnitude of said speech sample $s(n)$ is less than said clipping threshold signal;

peak determining means for supplying the maximum valued speech sample within selected ones of said $k$ intervals;

means for determining the least valued speech sample of those maximum values speech samples which are supplied by said peak determining means;

means for establishing said clipping level threshold signal as a predetermined fractional portion of said least valued speech sample;

means for storing said N clipped signals $x(n)$, $n$=0, 1,. . .,N-1;

addressing means for sequentially addressing a pair of said N clipped stored signals, $x(n)$ and $x(n+m)$, over the range $n$=0 to $n$=N-1 $x(n)$ is the nth one of said stored clipped signals, $m$ is a predetermined autocorrelation lag element and $x(n+m)$ is the $(n=m)$th one of said stored clipped signals;

combinational logic means responsive to each pair of addressed clip signals $x(n)$ and $x(n+m)$, $n$=0, 1,. . .N=1 for supplying a predetermined digital signal indicative of the combined values of $x(n)$ and $x(n+m)$, said combinational logic means supplying a first predetermined digital signal when either $x(n)$ or $x(n+m)$ corresponds to said third digital word supplied by said clipping means, said combinational logic means supplying a second predetermined digital signal when $x(n)$ and $x(n+m)$ correspond to said first and second digital words supplied by said clipping means, said combinational logic means supplying a third predetermined digital signal when both $x(n)$ and $x(n+m)$ correspond to said first predetermined digital word supplied by said clipping means, said combinational logic means further supplying said third predetermined digital signal when both $x(n)$ and $x(N+m)$ correspond to said second digital word supplied by said clipping means;

means for accumulating said digital signals supplied by said combinational logic means to determine the value of the autocorrelation function at said mth lag element, said accumulating means supplying a signal which is equivalent to the number of third predetermined digital signals supplied by said combinational logic means minus the number of said second predetermined digital signals supplied by said combinational logic means;

means for incrementing said predetermined lag element m over a predetermined lag range $M_i$ to $M_f$;

means for determining the maximum value of the autocorrelation value over said lag range $M_i$ to $M_f$;

means for determining the lag element which corresponds to said maximum autocorrelation value to supply an output indicative of said pitch period; and means for altering the predetermined speech interval of said speech samples, said interval alteration means including means for eliminating speech samples $s(n-k)$, $s(n-k+1)$,..., $s(n-1)$ of the original predetermined speech interval means for transferring speech samples $s(0)$, $s(1)$,..., $s(n-k-1)$ of said original speech interval to correspond to speech samples $s(k)$, $s(k+1)$,...,$s(n-1)$ of said altered speech interval and means for supplying the next k speech samples arriving at the input terminal of said speech analyzer as speech samples $s(0)$, $s(1)$,..., $s(k-1)$ of said altered speech interval.

18. The speech analyzer of claim 17 further comprising means for suppressing said pitch indicative output signal whenever said maximum value of said autocorrelation function over said lag range $M_i$ to $M_f$ is less than a predetermined voicing threshold.

19. The speech analyzer of claim 18 wherein said speech analyzer further comprises means for determining the autocorrelation value at the zero lag element; and means for supplying said predetermined voicing threshold as a fractional portion of said zero lag autocorrelation value.

20. The speech analyzer of claim 17 wherein said clipping means includes:

means for comparing each of said speech samples $s(n)$, $n$=0, 1, ..., N-1 with a predetermined threshold level indicative of the background noise in the environment in which said speech analyzer is operating, said clipping means further including means for supplying said third digital word whenever said threshold level is greater than said speech sample $s(n)$, irrespective of the relationship between said speech sample $s(n)$ and said clipping level threshold.

21. The speech analyzer of claim 17 wherein said speech analyzer further comprises means for determining the speech energy of the first $k$ speech samples of said predetermined speech interval, said energy determining means including means for summing said speech samples $s(n)$, $n = 0, 1,...,k-1$.

22. A speech analyzer for continuously determining the pitch period of a digitally encoded speech signal comprising:

first, second and third serially connected shift registers, each of said shift registers for storing a plurality of $k$ consecutive digital speech samples to form a speech analysis interval including 3k digitally encoded speech samples;

means for loading said 3k digitally encoded speech samples into said first, second and third shift registers in the order in which said speech samples are received by said speech analyzer;

means for determining the peak valued speech sample contained within said first shift register;

means for determining the peak valued speech sample contained within said third shift register;

means for determining the least valued one of said peak valued samples of said first and third shift registers;

means for multiplying said least valued peak speech sample of said first and third shift registers by a predetermined fraction to form a clipping level threshold signal;

means for comparing each of the 3k digitally encoded speech signals stored in said first, second and third shift registers with said clipping threshold signal, said comparing means supplying a first predetermined digitally encoded word when the magnitude of a particular speech sample is less than magnitude of said clipping threshold signal, said comparing means supplying a second predetermined digital signal when the magnitude of a particular speech sample exceeds the magnitude of said clipping threshold signal and said speech signal is positive, said comparing means supplying a third predetermined digital word when the magnitude of a particular speech sample exceeds the magnitude of said clipping threshold signal and said speech sample is negative;

means for storing the 3k signals supplied by said comparing means;

means for sequentially accessing the signal $x(n)$ from within said storage means for $n$=0 1,. . .,3k − 1;

means for sequentially accessing the signal $x(n+m)$ from within said storage means for $n$=0, 1,..., $3k-1$ where $m$ denotes a particular autocorrelation lag element within the lag range $M_i$ to $M_f$;

computational means responsive to said accessed signal $x(n)$ and said accessed signal $x(n+m)$ to supply a first predetermined counter signal when $x(n)$ or $x(n+m)$ corresponds to said first digitally encoded word supplied by said comparing means, said computational means supplying a second predetermined counter signal when one of said signals $x(n)$ and $x(n+m)$ corresponds to said second digitally encoded word supplied by said comparing means and the other one of said signals corresponds to said third digitally encoded word supplied by said comparing means, said computational means supplying a third predetermined counter signal when said signal $x(n)$ and $x(n+m)$ each correspond to said second digitally encoded word, said computational means further supplying said third predetermined counter signal when said signals $x(n)$ and $x(n+m)$ each correspond to said third digitally encoded word;

counter means responsive to said second and third counter signals to determine the value of the autocorrelation function at said lag element $m$, said counter means supplying a signal representative of the mathematical difference between the number of said third counter signals and the number of said second counter signal;

means for incrementing said lag element $m$ over the range $M_i$ to $M_f$;

means for indicating the pitch period over said predetermined speech interval, said pitch indicative means including means for determining the lag element within said lag range $M_i$ to $M_f$ which exhibits the maximum autocorrelation value; and means for updating said speech analysis interval with the next $k$ speech samples arriving at said speech analyzer, said updating means including means for sequentially transferring the $k$ speech samples stored in said first shift register into the storage locations of said second shift register, means for sequentially transferring the $k$ speech samples stored in said second shift register into the storage location of said third shift register and means for sequentially transferring said next arriving $k$ speech sample into the storage locations of said first shift register.

23. The speech analyzer of claim 22 wherein said means for determining said peak valued speech samples of said speech samples contained in said shift register and said means for determining said peak valued sample contained in said third shift register each include comparator means for comparing each speech sample transferred to said first and third shift registers with the maximum valued speech sample of those ones of said $k$ speech samples which have been previously transferred to said first and third shift registers.

24. The speech analyzer of claim 23 wherein said means for selecting said least valued one of said first shift register peak speech samples and said third shift register peak speech sample includes comparator means responsive to said peak valued sample of said first shift register and said peak valed sample of said third shift register.

25. The speech analyzer of claim 24 wherein said pitch indicative means includes a comparator circuit responsive to the value of the autocorrelation function at each lag element m and the maximum value of the autocorrelation function at previously computed lag elements $M_i$, $M_i + 1, \ldots, m$ and storage means responsive to the output signal of said comparator means for continuously storing a digitally encoded word corresponding to the maximum value of the autocorrelation function at the computed lag elements of said lag range $M_i$ to $M_f$, said pitch indicative means further including storage means responsive to said comparator output signal for continuously storing a signal corresponding to the lag element at which said maximum value of the autocorrelation function occurs.

26. The speech analyzer of claim 25 wherein said means for updating said speech analyzer interval includes clock means for generating a control signal each time a speech sample arrives at the input terminals of said speech analyzer, said control signal controlling said first, second and third shift registers to advance each of said $k$ speech samples stored therein by one storage location, said control signal further controlling said first shift register to load said arriving speech sample into the first storage location of said first shift register.

27. The speech analyzer of claim 26 further comprising means for comparing said peak valued speech sample of said first shift register with a predetermined silence threshold and means for suppressing the calculation of the pitch periods during intervals of time in which said predetermined silence threshold exceeds said peak valued speech samples of said first shift register.

28. The speech analyzer of claim 27 wherein said silence threshold is the maximum valued digitally encoded signal detected by said means for determining the peak valued speech sample within said first shift register during a training interval in which said speech analyzer receives a predetermined number of digitally encoded samples representative of the background noise level.

29. The speech analyzer of claim 28 further comprising means for determining whether the speech sample is voiced or unvoiced over the speech interval including said 3k speech samples, said voice-unvoiced means including means for comparing said digitally encoded word corresponding to the maximum value of the autocorrelation function within said lag range $M_i$ to $M_f$ with a predetermined voiced-unvoiced threshold.

30. The speech analyzer of claim 29 further comprising means responsive to said voiced-unvoiced determination means for suppressing the pitch period output of said speech analyzer during any particular interval of said 3k speech samples in which said voiced-unvoiced threshold exceeds said maximum autocorrelation value, said suppression means including means for clearing said storage means of said pitch determining means whenever said voiced-unvoiced threshold exceeds said maximum autocorrelation value.

31. The speech analyzer of claim 30 wherein said voiced-unvoiced threshold is a predetermined fractional portion of the value of the autocorrelation function at the zero lag element.

32. The speech analyzer of claim 31 wherein said value of said autocorrelation function at said zero lag element is calculated prior to the computation of the autocorrelation function over the lag range $M_i$ to $M_f$, said means for accessing said signal $x(n)$ and said means for accessing said signal $x(n+m)$ each acessing said signal $x(n)$ over the range $n=0, 1, \ldots, (3k-1)$.

33. The speech analyzer of claim 32 wherein said predetermined fractional multiplier is a digitally encoded word including a plurality of binary signals and said means for determining whether said speech interval is voiced or unvoiced includes an accumulator circuit responsive to each binary signal of said digitally encoded predetermined fractional multiplier for accumulating corresponding binary bits of said digitally encoded zero lag autocorrelation value.

34. The speech analyzer of claim 33 further comprising means for determining the speech energy of said k speech samples stored within said first shift register.

35. The speech analyzer of claim 34 wherein said energy determining means includes a digital accumulator circuit for summing the absolute values of said $k$ speech samples of said first shift register as they are loaded into said first shift register during said update sequence.

* * * * *